US009065205B2

(12) United States Patent
Gao et al.

(10) Patent No.: US 9,065,205 B2
(45) Date of Patent: Jun. 23, 2015

(54) CONNECTOR INSERT HAVING A CABLE CRIMP PORTION WITH PROTRUSIONS AND A RECEPTACLE HAVING LABEL IN THE FRONT

(75) Inventors: Zheng Gao, San Jose, CA (US); Josh Pong, San Jose, CA (US); Chris Ligtenberg, San Carlos, CA (US); Bartley K. Andre, Menlo Park, CA (US); Bradley J. Hamel, Redwood City, CA (US); John C. DiFonzo, Emerald Hills, CA (US); Dave Narajowski, Los Gatos, CA (US); Greg Springer, Orinda, CA (US); Eric Monsef, Los Gatos, CA (US); Min Chul Kim, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 241 days.

(21) Appl. No.: 13/458,853

(22) Filed: Apr. 27, 2012

(65) Prior Publication Data

US 2013/0040470 A1 Feb. 14, 2013

Related U.S. Application Data

(60) Provisional application No. 61/522,625, filed on Aug. 11, 2011, provisional application No. 61/599,921, filed on Feb. 16, 2012.

(51) Int. Cl.
*H01R 13/60* (2006.01)
*H01R 13/62* (2006.01)
(Continued)

(52) U.S. Cl.
CPC ..... *H01R 13/6205* (2013.01); *Y10T 29/49204* (2013.01); *H01R 12/57* (2013.01);
(Continued)

(58) Field of Classification Search
CPC ..... H01R 13/6205; H01R 11/30
USPC ..... 439/38–40, 45, 129, 700, 824, 939
See application file for complete search history.

(56) References Cited

U.S. PATENT DOCUMENTS 2,170,287 A 8/1939 Kinnebrew
2,234,982 A 3/1941 Ross
(Continued)

FOREIGN PATENT DOCUMENTS

BZ 2122915 A1 3/1994
CZ 20 2004 003 202 U1 6/2004
(Continued)

OTHER PUBLICATIONS

"Presto 9984 Control Master Heat Control with Magnetic Cord," obtained from http://www.cookingandcanning.net/pr99comaheco.html, generated Jan. 18, 2006, 1-pg.
National Presto Industries, Inc., "Magnetic Cord for Electric Deep Fryers," obtained from http://www.gopresto.com/productslproducts.php?stock=09982. generated Jan. 18, 2006, 1-pg.
Dowell Trading Co, Ltd.,"News for Break Away Power Cords on Electric Deep Fryers," copyright 2002, 1-pg.
(Continued)

*Primary Examiner* — Chandrika Prasad
(74) *Attorney, Agent, or Firm* — Kilpatrick Townsend & Stockton LLP

(57) ABSTRACT

A magnetic connector system having a durable and reliable construction and a reduced height while maintaining sufficient holding strength. A connector insert may utilize a crimping piece to crimp a braiding of a cable. The crimping piece may be fixed to an attraction plate and a board in the insert for mechanical reliability. Retention clips may be used to fix a shell to the attraction plate. A connector receptacle may employ a magnetically conductive label to improve holding strength.

21 Claims, 27 Drawing Sheets

(51) Int. Cl.

| | |
|---|---|
| ***H01R 13/508*** | (2006.01) |
| ***H01R 13/58*** | (2006.01) |
| ***H01R 13/66*** | (2006.01) |
| ***H01R 13/6592*** | (2011.01) |
| ***H01R 13/658*** | (2011.01) |
| *H01R 12/57* | (2011.01) |
| *H01R 13/717* | (2006.01) |
| *H01R 13/6471* | (2011.01) |

(52) U.S. Cl.

CPC ..... *H01R 13/508* (2013.01); *H01R 13/5808* (2013.01); *H01R 13/6658* (2013.01); *H01R 13/7172* (2013.01); *H01R 13/7175* (2013.01); *H01R 13/6471* (2013.01); *H01R 13/6592* (2013.01); *H01R 13/658* (2013.01)

(56) References Cited

U.S. PATENT DOCUMENTS 3,144,527 A 8/1964 Tolegian
3,363,214 A 1/1968 Wright
3,431,428 A 3/1969 Valer
3,521,216 A 7/1970 Tolegian
3,713,370 A 1/1973 Prijn
3,786,391 A 1/1974 Mathauser
3,808,577 A 4/1974 Mathauser
3,810,258 A 5/1974 Mathauser
3,868,160 A 2/1975 Kersman
4,211,456 A 7/1980 Sears
4,317,969 A 3/1982 Riegler et al.
4,669,791 A 6/1987 Savill
4,712,234 A 12/1987 Below et al.
4,810,202 A 3/1989 Nodfelt
4,844,582 A 7/1989 Giannini
5,382,167 A 1/1995 Janson, Jr.
5,385,476 A 1/1995 Jasper
5,692,786 A 12/1997 Berger
5,696,861 A 12/1997 Schimmeyer et al.
5,704,802 A 1/1998 Loudermilk
5,812,356 A 9/1998 O'Connor
5,829,987 A 11/1998 Fritsch et al.
5,865,645 A * 2/1999 Embo et al. ..... 439/567
5,885,100 A 3/1999 Talend et al.
5,921,783 A 7/1999 Fritsch et al.
5,941,729 A 8/1999 Sri-Jayantha
5,954,520 A 9/1999 Schmidt
6,007,363 A 12/1999 Renk
6,030,229 A 2/2000 Tsutsui
6,042,385 A 3/2000 Watanabe et al.
6,088,752 A 7/2000 Ahern
6,094,122 A 7/2000 Sexton
6,165,006 A 12/2000 Yeh et al.
6,174,194 B1 1/2001 Bleicher et al.
6,183,264 B1 2/2001 Harsanyi
6,211,581 B1 4/2001 Farrant
6,217,339 B1 4/2001 Tsubata
6,219,267 B1 4/2001 Andres
6,238,219 B1 5/2001 Wu
6,250,931 B1 6/2001 Mendelson
6,267,602 B1 7/2001 Mendelson et al.
6,340,302 B1 1/2002 Ladd
6,358,069 B2 3/2002 Yoshioka et al.
6,419,521 B2 7/2002 Kanagawa et al.
6,431,902 B1 * 8/2002 Yeh ..... 439/358
6,464,509 B1 10/2002 Emberty et al.
6,466,718 B1 10/2002 Linnell
6,478,614 B1 11/2002 De'Longhi
6,485,338 B1 11/2002 Wu
6,522,033 B1 2/2003 Nevo
6,527,570 B1 3/2003 Hartman et al.
6,528,746 B2 3/2003 DeWitt et al.
6,545,577 B2 4/2003 Yap
6,561,815 B1 5/2003 Schmidt
6,565,363 B2 5/2003 Downing
6,595,801 B1 7/2003 Leonard et al.
6,607,391 B2 8/2003 Mendelson et al.
6,616,468 B2 9/2003 Sakiyama
6,623,276 B2 9/2003 Damau Ferrerfabrega
6,727,477 B1 4/2004 Li-Chen
6,733,333 B1 5/2004 Chen
6,773,312 B2 8/2004 Bauer et al.
6,814,626 B2 11/2004 Wen-Yao
6,815,610 B2 11/2004 Kuboshima et al.
6,821,126 B2 11/2004 Neidlein
6,966,781 B1 11/2005 Bullinger et al.
6,976,882 B2 12/2005 Kernan
6,988,897 B2 1/2006 Belongia et al.
7,032,288 B2 4/2006 Ladd
7,112,103 B2 9/2006 Zhang et al.
7,121,707 B2 10/2006 Currie et al.
7,198,295 B2 4/2007 Biziorek et al.
7,217,142 B1 5/2007 Wu
7,247,046 B1 7/2007 Wu
7,264,479 B1 9/2007 Lee
7,306,479 B1 12/2007 Wu
7,311,526 B2 12/2007 Rohrbach et al.
7,329,128 B1 2/2008 Awad
7,332,990 B2 2/2008 Lo et al.
7,351,066 B2 4/2008 DiFonzo et al.
7,364,433 B2 4/2008 Neidlein
7,419,378 B2 9/2008 Ha et al.
7,429,188 B2 9/2008 Wu
7,445,452 B1 * 11/2008 Wu ..... 439/39
7,497,693 B1 3/2009 Wu
7,498,546 B2 3/2009 Belongia et al.
7,517,222 B2 4/2009 Rohrbach et al.
7,625,213 B1 12/2009 Tse
7,645,143 B2 1/2010 Rohrbach et al.
7,717,733 B1 5/2010 Yi et al.
7,775,801 B2 8/2010 Shiff et al.
7,901,216 B2 3/2011 Rohrbach et al.
7,931,472 B2 4/2011 David et al.
7,963,773 B2 * 6/2011 Palli et al. ..... 439/38
8,043,123 B2 10/2011 Hsieh
8,087,939 B2 1/2012 Rohrbach et al.
8,172,580 B1 5/2012 Chen et al.
8,177,560 B2 5/2012 Rohrbach et al.
8,241,043 B1 8/2012 Lin
8,342,857 B2 * 1/2013 Palli et al. ..... 439/38
8,435,042 B2 5/2013 Rohrbach et al.
8,535,088 B2 * 9/2013 Gao et al. ..... 439/490
2002/0002004 A1 * 1/2002 Akama et al. ..... 439/625
2002/0044746 A1 4/2002 Kronlund et al.
2002/0054686 A1 5/2002 Tabata et al.
2002/0123250 A1 9/2002 Wang
2003/0148643 A1 8/2003 Yoji
2004/0077187 A1 4/2004 Belongia et al.
2004/0184295 A1 9/2004 Robertson et al.
2004/0209489 A1 10/2004 Clapper
2004/0224539 A1 11/2004 Boyd et al.
2004/0257741 A1 12/2004 Cuny et al.
2005/0082915 A1 4/2005 Steinberg
2005/0208783 A1 9/2005 Suzki et al.
2005/0255718 A1 11/2005 McLeish
2005/0255719 A1 11/2005 Heidlein
2006/0051981 A1 3/2006 Neidlein et al.
2006/0067690 A1 3/2006 Tatum et al.
2006/0164447 A1 7/2006 Poole et al.
2007/0067654 A1 3/2007 Adachi
2007/0072443 A1 3/2007 Rohrbach et al.
2007/0085516 A1 4/2007 Fenwick et al.
2007/0107068 A1 5/2007 Kelley et al.
2007/0112989 A1 5/2007 Iwaki
2007/0184674 A1 8/2007 Koch
2008/0211310 A1 9/2008 Jitaru et al.
2009/0142962 A1 6/2009 Zhang
2009/0269943 A1 * 10/2009 Palli et al. ..... 439/39
2010/0080563 A1 * 4/2010 DiFonzo et al. ..... 398/115
2011/0092081 A1 4/2011 Gao et al.
2011/0136350 A1 6/2011 Palli et al.
2012/0148196 A1 6/2012 Penumatcha et al.
2012/0295451 A1 11/2012 Hyun-Jun et al.
2013/0005159 A1 1/2013 Gao et al.

(56) References Cited

U.S. PATENT DOCUMENTS

| | | | |
|---|---|---|---|
| 2013/0065406 | A1 | 3/2013 | Rohrbach et al. |
| 2014/0235075 | A1 | 8/2014 | Kim et al. |
| 2014/0287601 | A1 | 9/2014 | Suh |

FOREIGN PATENT DOCUMENTS

| | | | |
|---|---|---|---|
| DE | 3904708 | C1 | 1/1990 |
| DE | 3622948 | A1 | 1/1998 |
| DE | 19820691 | A1 | 2/1999 |
| DE | 102 42 645 | A1 | 3/2004 |
| DE | 103 33 403 | A | 9/2004 |
| DE | 202010002522 | U1 | 7/2010 |
| EP | 0 112 019 | A1 | 6/1984 |
| EP | 0 289 208 | A2 | 11/1988 |
| EP | 0 573 471 | B1 | 10/1994 |
| EP | 1 194 983 | B1 | 9/2003 |
| FR | 2 566 195 | A1 | 12/1985 |
| FR | 2 665 305 | A1 | 1/1992 |
| FR | 2 685 981 | A1 | 7/1993 |
| GB | 1232922 | B1 | 5/1971 |
| GB | 2174556 | A | 11/1986 |
| GB | 2383476 | A | 6/2003 |
| JP | 50-9990 | B | 4/1975 |
| JP | 03-059973 | | 3/1991 |
| JP | 4-296475 | A | 10/1992 |
| JP | 05-335051 | | 12/1993 |
| JP | 7-6817 | A | 1/1995 |
| JP | 11-09467 | A | 1/1999 |
| JP | 11-144803 | A | 5/1999 |
| JP | 11-273770 | A | 10/1999 |
| JP | 2000/12145 | A | 1/2000 |
| JP | 2000/30806 | A | 1/2000 |
| JP | 2002/056929 | A | 2/2002 |
| JP | 2002-270279 | A | 9/2002 |
| JP | 2002/367724 | A | 12/2002 |
| JP | 2003/082519 | A | 3/2003 |
| JP | 2004/203973 | A | 7/2004 |
| WO | 94/06174 | A1 | 3/1994 |
| WO | 95/06970 | A1 | 3/1995 |
| WO | 2004/027937 | A1 | 4/2004 |
| WO | 2004/095647 | A1 | 11/2004 |
| WO | 2005/006913 | A1 | 1/2005 |
| WO | 2011/049838 | | 4/2011 |

OTHER PUBLICATIONS

CNN.com, "'Break-away cord aims to make deep fryers safer," obtained from http:/larchives.cnn.com/2001/US/07/03/deep.fryers/, dated Jul. 4, 2001, 2-pgs.

"Zojirushi Hot Water Dispensing Pot Review," obtained from http://www.pkshiu.comtlof/archive/2005/01/zojirushi-hot-water-dispensing-pot.review, dated Jan. 5, 2005, 2-pgs.

U.S. Consumer Product Safety Commission, "Consumer Product Safety Review," Winter 2002, vol. 6, No. 3, total of 12-pgs., see p. 5.

English Abstract of JP2002056929 to Zojirushi Corp, obtained from http://esp@cenet.com, 1-pg.

Search/Examination Report dated Aug. 3, 2009 from European Patent Application No. 09159211.3, 8 pages.

Search/Examination Report dated Dec. 3, 2010 from European Patent Application 10 011 081.6.

Search/Examination Report dated Mar. 3, 2011 from Great Britain Patent Office; GB1101348.9.

International Search Report dated Dec. 12, 2006 from PCT Patent Application No. PCT/US2006/031525.

Search/Examination Report dated Dec. 6, 2010 from European Patent Application 10 011 082.4.

Partial Search Report dated Dec. 6, 2010 from European Patent Application 10 011 083.2.

Search/Examination Report dated Mar. 30, 2011 from European Patent Application 10 011 083.2.

Partial Search Report dated Dec. 6, 2010 from European Patent Application 10 011 084.0.

Search/Examination Report dated Mar. 30, 2011 from European Patent Application 10 011 084.0.

Search/Examination Report dated Oct. 19, 2011 from European Patent Application 11176682.0.

International Search Reported dated Sep. 25, 2012, from PCT Patent Application No. PCT/US2012/045056, 11 pages.

International Search Report dated Oct. 17, 2012, from PCT Patent Application No. PCT/US2012/049870, 84 pages.

Translation of DE 20 2010 002 522 U1, Chen Ming Jen [TW]; Voit Stegan [DE], Jul. 8, 2010, pp. 1-6.

Taiwan Office Action mailed on Jul. 25, 2014 for TW Patent Application No. 101129107, with English translation, 14 pages.

Australian Office Action mailed on Aug. 6, 2014 for AU Patent Application No. 2012294552, 4 pages.

* cited by examiner

CONNECTOR INSERT HAVING A CABLE CRIMP PORTION WITH PROTRUSIONS AND A RECEPTACLE HAVING LABEL IN THE FRONT

CROSS-REFERENCES TO RELATED APPLICATIONS

This application claims the benefit of U.S. provisional patent application Nos. 61/522,625, filed Aug. 11, 2011, and 61/599,921, filed Feb. 16, 2012, which are incorporated by reference.

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive power and share data using various cables. These cables may have connector inserts, or plugs, on each end. The connector inserts may plug into connector receptacles on electronic devices, thereby forming one or more conductive paths for signals and power.

These connector inserts and connector receptacles may be magnetic. That is, a magnetic insert may be magnetically attracted to a magnet receptacle, and the two may be held in place in at least one direction by the magnetic attraction.

Conventional magnetic connectors have been fairly large in size. But the devices they connect to have often become much thinner, that is, they have a reduced height. This, in turn, leads to a desire for a thinner connector. But when a conventional connector is made thinner, it may not have sufficient holding power to maintain a connection between a connector insert and a connector receptacle.

Also, these connectors may be connected and disconnected thousands of times during a device's lifetime. This may cause a cable to become disconnected from a plug, or it may lead to other mechanical failure. For example, a shell or other housing may become detached from other parts of a plug or connector insert.

Thus, what is needed are magnetic connector systems having a durable and reliable construction and a reduced height while maintaining sufficient holding strength.

SUMMARY

Accordingly, embodiments of the present invention provide magnetic connector systems having a durable and reliable construction and a reduced height while maintaining sufficient holding strength.

An illustrative embodiment of the present invention provides a connector insert having a robust and durable construction. This connector insert may include a crimping piece crimped over an end of a cable. The crimping piece may include fingers in a direction of a length of the cable that attach to a printed circuit board. The crimping piece may further include protrusions that extend at right angles from the fingers. These protrusions may be fixed to the back of an attraction plate. These features may form a secure, robust connection between a cable and an attraction plate.

This connector insert may also include retention clips on sides of an attraction plate. These retention clips may retract when a shell is slid over the attraction plate, and may relax when they reach a cutout in the shell. This may fix the shell in place relative to the attraction plate in a reliable, easily manufactured manner.

This connector insert may also have a light-emitting diode attached to a printed circuit board. The connector may further include a light pipe attached to the printed circuit board, and the light pipe may be angled to pass above the light-emitting diode, and further angled to pass light to an opening in the shell.

Another illustrative embodiment of the present invention may provide a connector insert having a reduced height. To maintain sufficient magnetic holding strength with the reduced height, the connector insert may be made wider. This may, in turn, increase a surface area of an attraction plate, thereby increasing connector insert holding strength.

Another illustrative embodiment of the present invention may provide a connector receptacle. This connector receptacle may have a pleasing appearance from a front. Specifically, a front of a housing forming a mesa may be oversized, and the housing may be slid into an opening in a label, such that a seam between the housing and label may not be visible to a user.

Another illustrative embodiment of the present invention may provide a connector receptacle having a magnetically conductive label. This magnetically conductive label may increase the holding power of magnets behind the label. The label may be attached to a shield that has a lower magnetic conductivity. To reduce lost flux, the overlap between the label and the shield may be reduced by cutting out a portion of the label.

Another illustrative embodiment of the present invention may provide a connector system where a connector insert may be "blind mated" to a connector receptacle. That is, the connector insert and connector receptacle may be configured such that when the connector insert is brought into close proximity to the connector receptacle in approximately a correct orientation, the magnetic attraction between the connector insert and the connector receptacle is such that the connector insert may be pulled into contact with the connector receptacle. As part of this blind mating, the physical features of the connector insert and the connector receptacle may be such that they do not pose an obstacle to the formation of this connection. This may provide an easy way for a user to make a connection of a cable to a device. Specifically, the user merely brings the connector insert in approximately a correct orientation and into proximity of the connector receptacle. From there, the magnetic attraction between the connector insert and the connector receptacle brings them into contact. Also, the physical features are such that there may be no obstacles to the formation of the connection.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
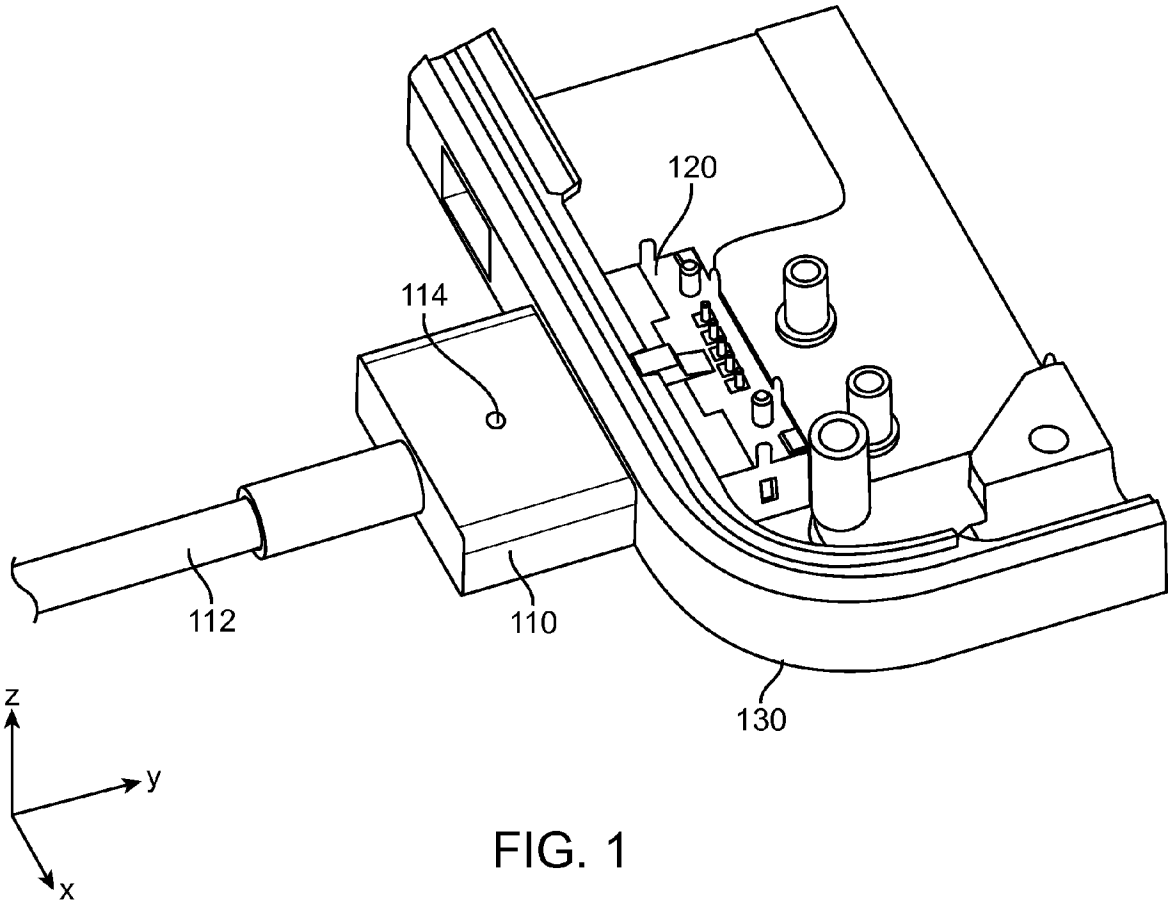
FIG. 1 illustrates a magnetic connector system according to an embodiment of the present invention.

FIG. 1 illustrates a magnetic connector system according to an embodiment of the present invention. This figure, as with the other included figures, is shown for illustrative purposes and does not limit either the possible embodiments of the present invention or the claims.

The illustrated magnetic connector system may include connector insert 110 and connector receptacle 120. Connector receptacle 120 may be located in enclosure 130, which may be an enclosure for a portable computing device, tablet, desktop, or all-in-one computer, cell, smart, or media phone, storage device, portable media player, navigation system, monitor or other device.

Connector insert 110 and connector receptacle 120 may be magnetic connectors. That is, connector insert 110 may be held in place relative to connector receptacle 120 in at least one direction by a magnetic force. For example, one or both of connector insert 110 and connector receptacle 120 may include one or more magnets, or magnetic elements or structures. These magnets may attract other magnets or magnetic structures in the other. For example, connector receptacle 120 may include one or more magnets which are attracted to an attraction plate in connector insert 110. In a specific embodiment of the present invention, connector receptacle 120 includes four magnets arranged to have alternating or opposing polarities which are attracted to an attraction plate made of a ferromagnetic material in connector insert 110. In another specific embodiment of the present invention, connector receptacle 120 may include three magnets arranged to have alternating polarities. In still other embodiments of the present invention, connector receptacle 120 may include one, two, or more than four magnets.

This magnetic connector system may be used to convey power, data, or other voltages or types of signals or information. In a specific embodiment of the present invention, the magnetic connector system conveys power to a device housed by device enclosure 130. In this embodiment, connector insert 110 may be connected to a power adapter via cable 112. This power adapter may receive power from a wall outlet, vehicle charger, or other power source. Connector insert 110 may also include circuitry for communicating with the power adapter. Examples of this may be found in co-pending U.S. provisional patent application No. 61/482,195, titled TIME-DOMAIN MULTIPLEXING OF POWER AND DATA, which is incorporated by reference. Connector insert 110 may further include circuitry for determining whether a valid connection to a connector receptacle has been made, and may provide an indication of such a connection using light-emitting diode opening 114.

Connector insert 110 may be held in place in a Y direction relative to connector receptacle 120 using magnetic force. Connector insert 110 may align in X and Z directions relative to connector receptacle 120 through physical features on connector insert 110, connector receptacle 120, and device enclosure 130. These physical features are arranged such that connector insert 110 is not physically bound to connector receptacle 120. This allows connector insert 110 to be removed by a non-axial force, that is, forces in directions other than those in the Y direction may remove connector insert 110. An attraction plate on connector insert 110 may have an outside edge designed to fit in an opening in enclosure 130. The attraction plate on connector insert 110 may have an opening designed to accept a mesa on connector receptacle 120. Contacts on connector insert 110 may be arranged to mate with contacts on connector receptacle 120 to form electrical pathways. These features are shown in various figures below.

Again, many electronic devices, such as portable media players, portable media devices, and laptop, netbook, and tablet computers are becoming thinner. That is, their height is being reduced. Accordingly, embodiments of the present invention may provide magnetic connector systems having a reduced height. Unfortunately, this reduced height may make it easier for connector insert 110 to be inadvertently disconnected from connector receptacle 120.

Specifically, as described above, connector insert 110 may be held in place relative to connector receptacle 120 in a Y direction using magnetic force. Since the thickness of connector insert 110 is reduced in a Z direction, a small force in this direction may dislodge connector insert 110. That is, due to the reduced thickness, the moment arm in the Z direction needed to disconnect the connector insert from the connector receptacle is reduced. Accordingly, a surface area of an attraction plate in connector insert 110 may be made correspondingly large. This, in turn, may increase the holding strength of the connector insert. An example is shown in the following figure.

Figure 2:
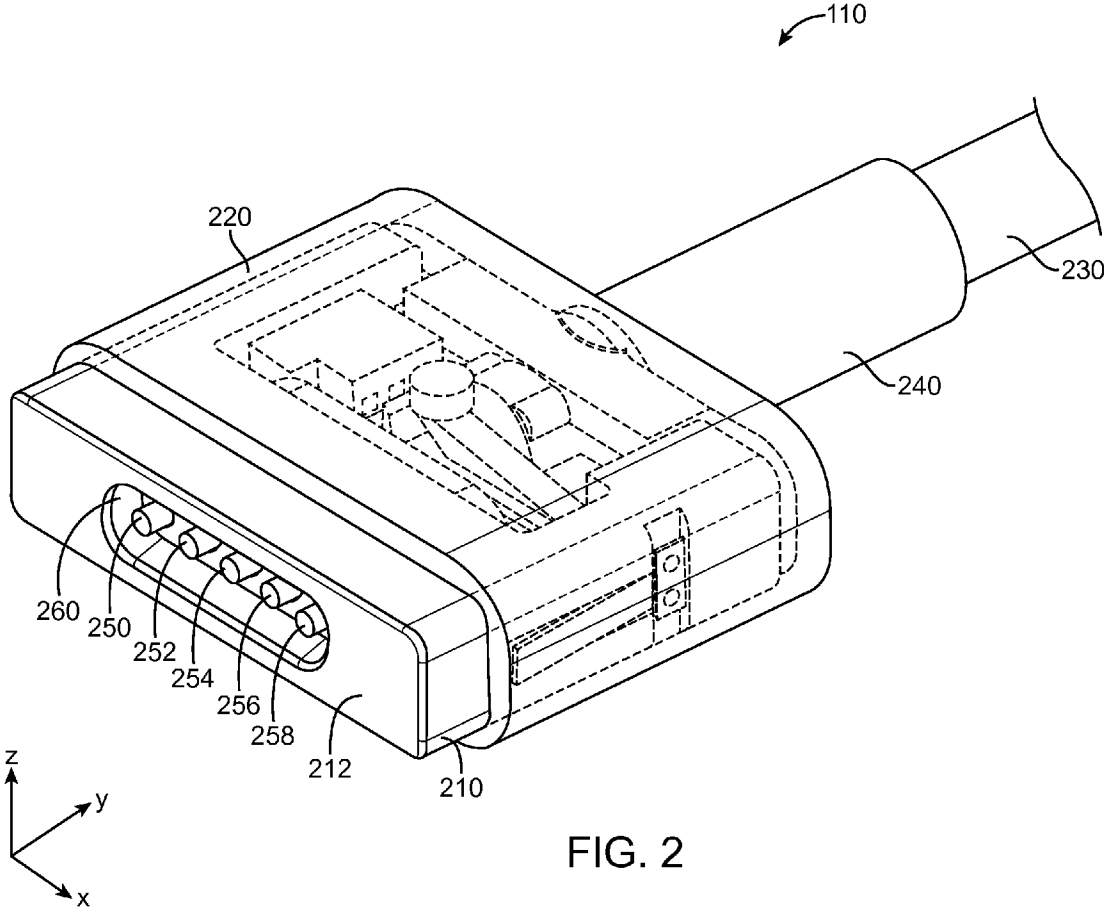
FIG. 2 illustrates a connector insert according to an embodiment of the present invention.

FIG. 2 illustrates a connector insert 110 according to an embodiment of the present invention. Connector insert 110 may include an attraction plate 210, shield or cover 220, cable 230, and strain relief 240. Attraction plate 210 may include front surface 212. Front surface 212 may include opening 260 for contacts 250, 252, 254, 256, and 258. In a specific embodiment of the present invention, contacts 250 and 258 may convey ground, contacts 252, and 256 may convey power, while contact 254 may be used to detect that a connection has been formed. In this specific example, ground contacts 250 and 258 protrude in front of the other contacts, such that ground paths are formed before power is applied when connector insert 110 is mated with a corresponding connector receptacle.

Again, connector insert 110 may be relatively thin, that is, it may have a reduced height in the Z direction. To increase the magnetic hold between connector insert 110 and connector receptacle 120, front surface area 212 of attraction plate 210 may be increased. For example, this may be done by making connector insert 110 wider. By making connector insert 110 wider, front surface area 212 of attraction plate 210 is increased, thereby increasing the holding power of connector insert 110.

Again, connector insert 110 may be inserted and disconnected several thousand times during the lifetime of a device. Therefore, it may be desirable that connector insert 110 be robust and durable. Accordingly, embodiments of the present invention employ several features to increase robustness and durability. For example, the physical connections between a cable and an attraction plate, and a shell and the attraction plate, may be enhanced. Examples are shown in the following figures.

Figure 3:
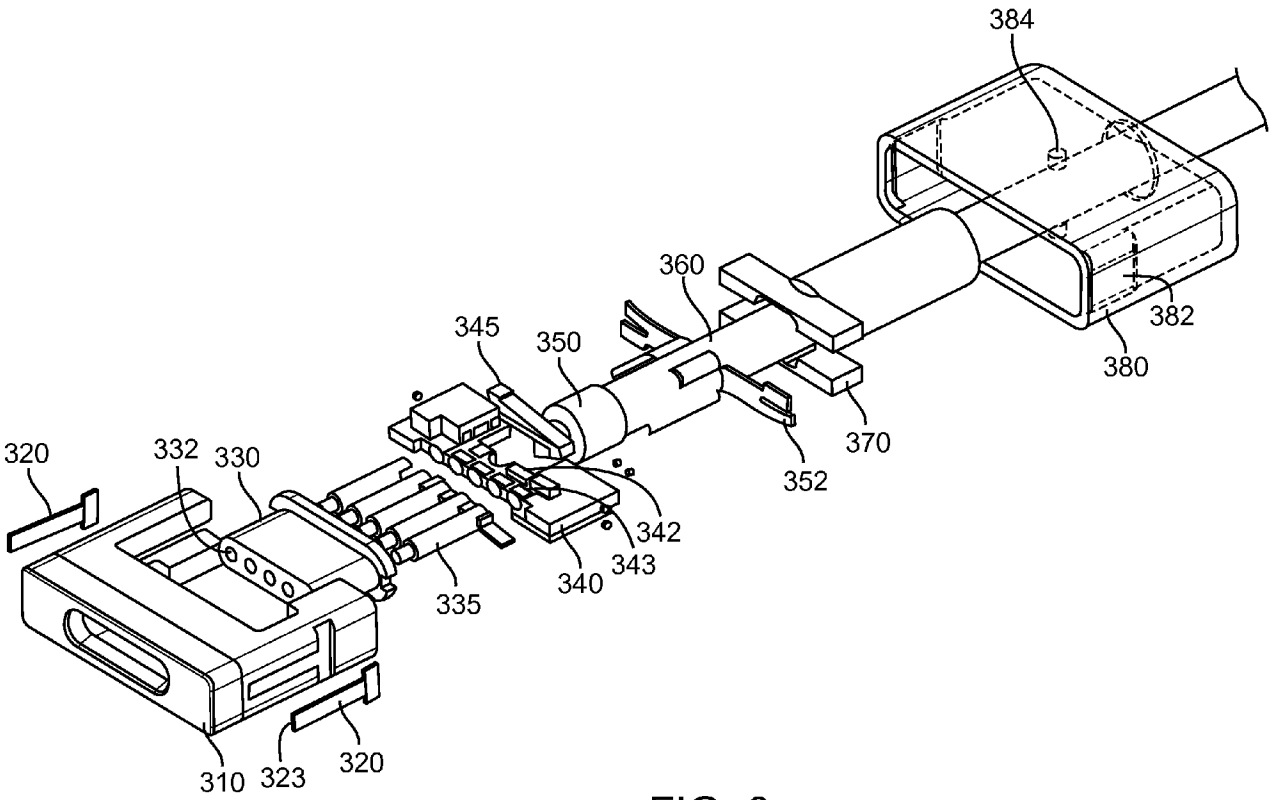
FIG. 3 illustrates an exploded view of a connector insert according to an embodiment of the present invention.

FIG. 3 illustrates an exploded view of a connector insert according to an embodiment of the present invention. This figure includes an attraction plate 310. Attraction plate 310 may be made of ferromagnetic or other magnetic material. In other embodiments of the present invention, attraction plate 310 may be formed of one or more magnets.

Retention clips 320 may be located on sides of attraction plate 310. Retention clips 320 may be used to secure shell 380 relative to attraction plate 310. Specifically, shell 380 may slide over attraction plate 310, pushing retention clips 320 against attraction plate 310. When edge 323 reaches cutout, groove, or slot portion 382 of shell 380, retention clip 320 may snap back, thereby holding shell 380 in place.

Housing 330 may be formed of a non-conducting or insulating material. Contacts 335 may be located in passages 332 in housing 330. Contacts 335 may attach to circuit board 340 at contacts 343. Circuit board 340 may include one or more LEDs 342. Light from LEDs 342 may be guided by light pipe 345 to opening 384 in shell 380.

Braiding in cable 360 may be pulled back and held in place by crimp piece 350. Crimp piece 350 may include wings or protrusions 352. Wings 352 may be spot-welded or otherwise fixed to a back of attraction plate 310 to hold cable 360 in place relative to attraction plate 310. Strain relief 370 may protect cable 360. Shell 380 may be placed over these components and part of attraction plate 310.

Shell 380 may provide a surface that may be manipulated by a user during insertion and extraction of connector insert 110. Shell 380 may be plastic, brushed aluminum, or other material. Shell 380 may include openings 382 on one or both sides. These openings may be filled with epoxy or other clear or colored material to prevent debris from entering opening 382.

A connector insert according to an embodiment of the present invention may be assembled in various ways. In a specific embodiment of the present invention, contacts 335 may be inserted into housing 330. Contacts 335 may then be attached to printed circuit board 340. Crimp piece 350 may be used to crimp cable 360. The resulting cable may be attached to printed circuit board 340. Specifically, fingers (not shown) may be soldered or otherwise fixed to printed circuit board 340. This assembly may be inserted in attraction plate 310. Crimp piece wings 352 may be fixed to a back of attraction plate 310. Strain relief 370 may be slid over cable 360 and wings 352. Light pipe 345 may be attached to printed circuit board 340. Retention clips 320 may be attached to attraction plate 310. Shell 380 may slide over attraction plate 310 until retaining chips 320 lock in place in notch 382.

Figure 4:
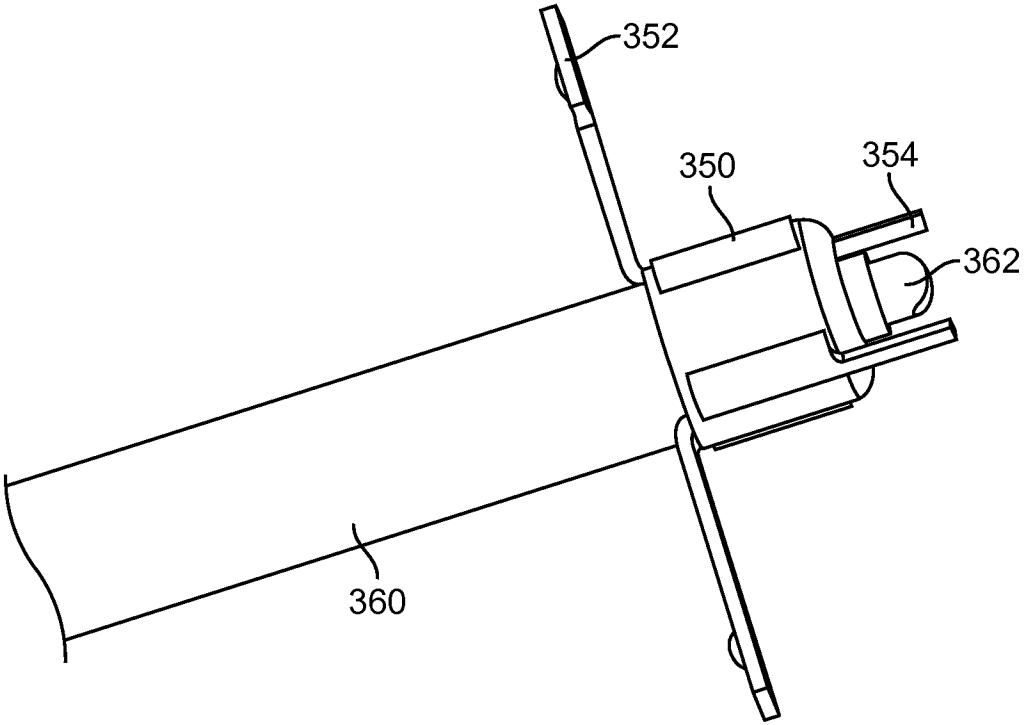
FIG. 4 illustrates a cable crimped by a crimp piece according to an embodiment of the present invention.

FIG. 4 illustrates a cable crimped by a crimp piece according to an embodiment of the present invention. Cable 360 may include a braid and center conductor 362. Center conductor 362 may be used to convey power, while the braid may be used to convey ground. The braid may be folded back and covered by crimp piece 350. Crimp piece 350 may be crimped to form a secure connection to cable 360. Crimp piece 350 may include protrusions or wings 352 and fingers 354. Wings 352 may be spot welded or otherwise attached to the back of an attraction plate. Fingers 354 may be soldered to a printed circuit board. These connections may provide a secure connection between cable 360 and a connector insert.

Figure 5:
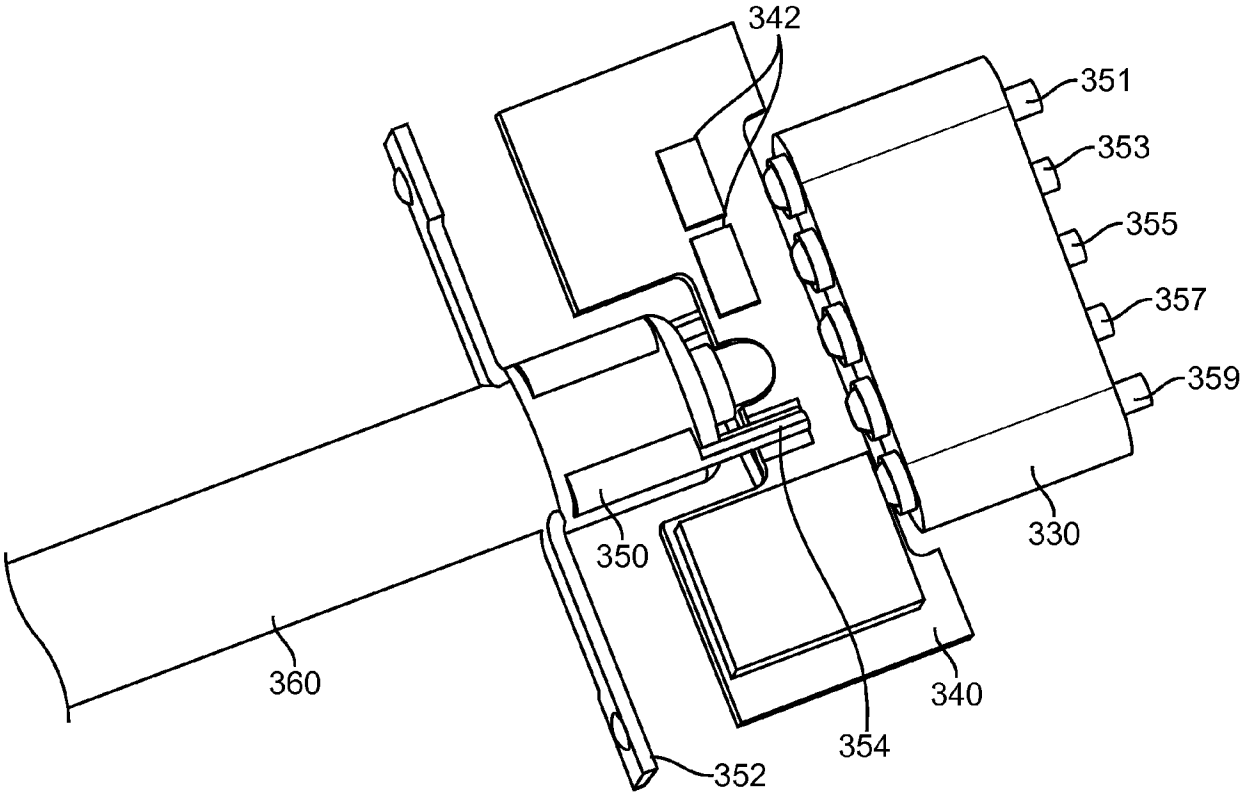
FIG. 5 illustrates a partial assembly of a connector insert according to an embodiment of the present invention.

FIG. 5 illustrates a partial assembly of a connector insert according to an embodiment of the present invention. Contacts 351, 353, 355, 357, and 359 may be located in housing 330. These contacts may also be attached to printed circuit board 340. Printed circuit board 340 may include LEDs 342. Fingers 354 of crimp piece 350 may be attached to printed circuit board 340.

Figure 6:
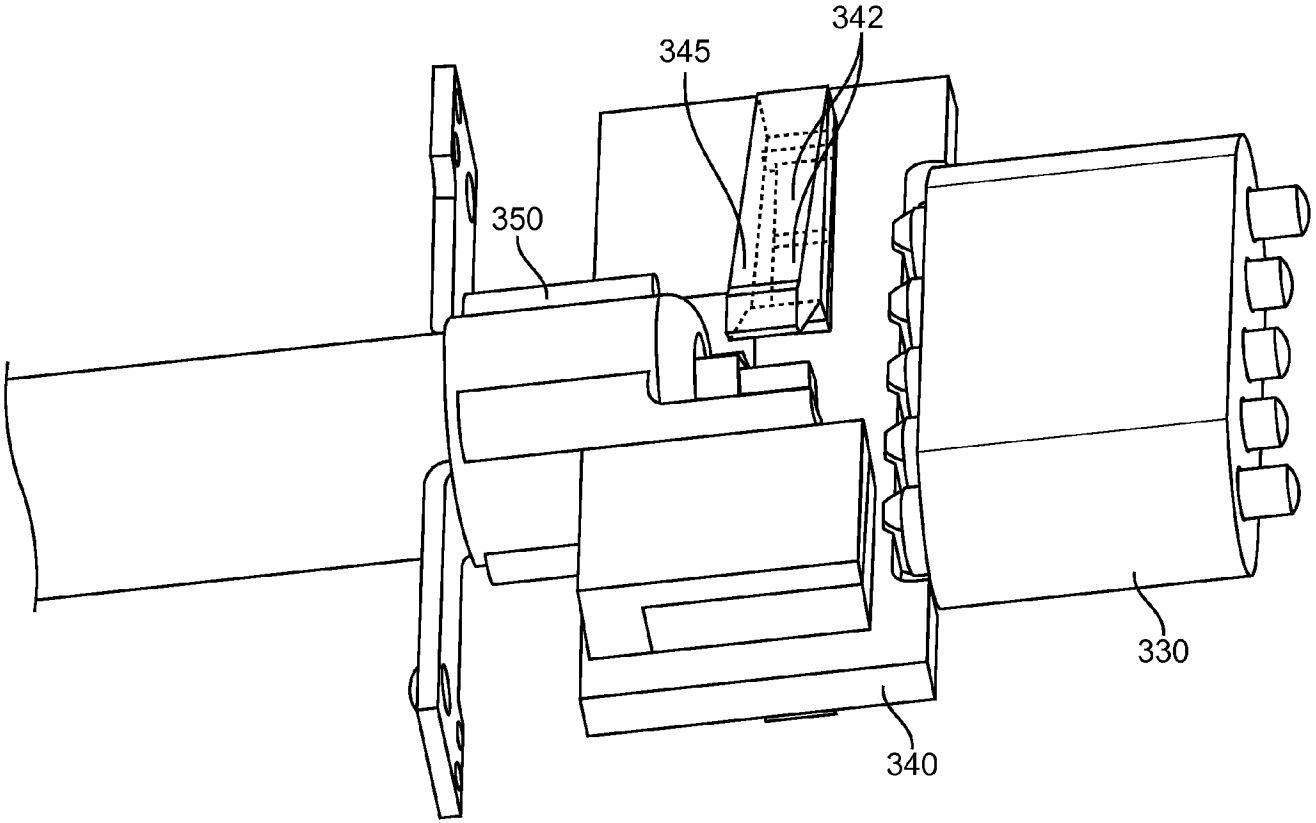
FIG. 6 illustrates another partial assembly of a connector insert according to an embodiment of the present invention.

FIG. 6 illustrates another partial assembly of a connector insert according to an embodiment of the present invention. In this example, light pipe 345 has been placed above LEDs 342. Light pipe 345 acts as a light guide to transfer light from LEDs 342 to opening 384 in shell 380. Light pipe 345 may attach to the printed circuit board. Light pipe 345 may be angled to pass above light-emitting diodes 342, and further angled to pass light to an opening in the shell.

Figure 7:
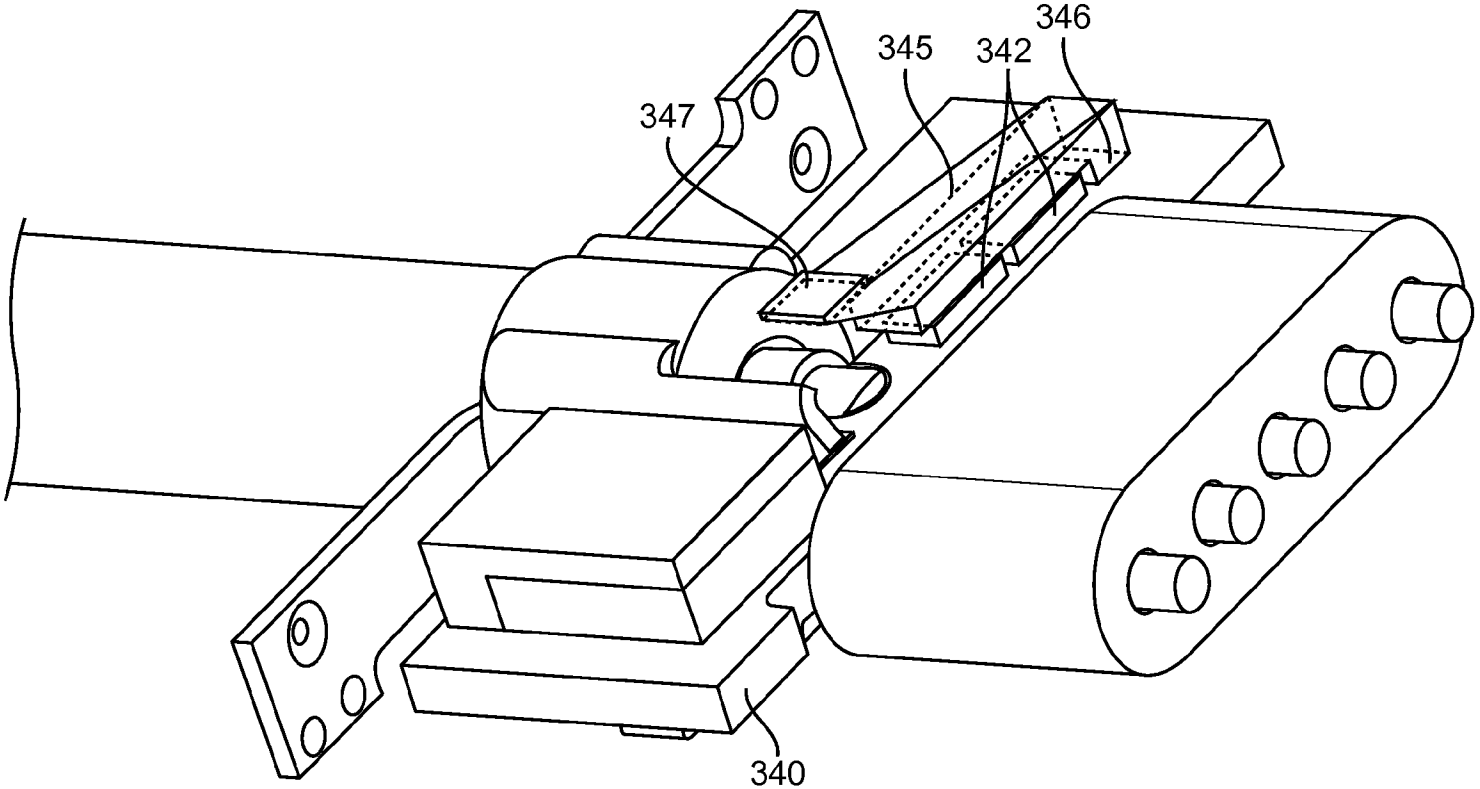
FIG. 7 illustrates a side view of the partial assembly of FIG. 6.

FIG. 7 illustrates a side view of the partial assembly of FIG. 6. Again, light pipe 345 guides light emitted by diodes 342 into opening 382 and shell 380. Light pipe 345 may attach to printed circuit board 340 at 346 and extend across LEDs 342. Portion 347 may be flat to present light to opening 382 in shell 380.

Figure 8:
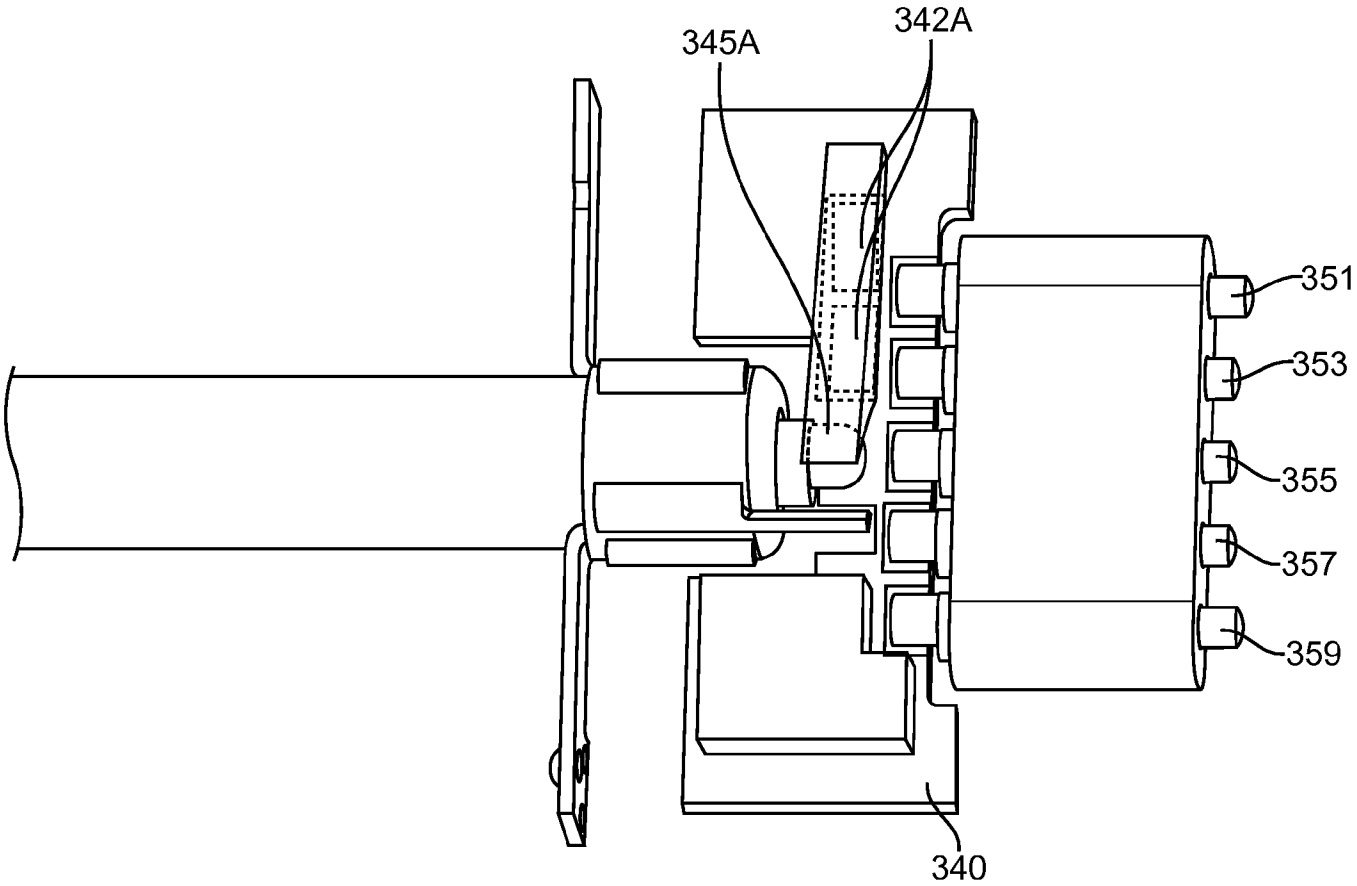
FIG. 8 illustrates a back side of the partial assembly shown in FIG. 6.

FIG. 8 illustrates a back side of the partial assembly shown in FIG. 6. The backside may also include LEDs 342A and light pipe 345A. Contacts 351, 353, 355, 357, and 359 may be soldered to printed circuit board 340, as shown.

Figure 9:
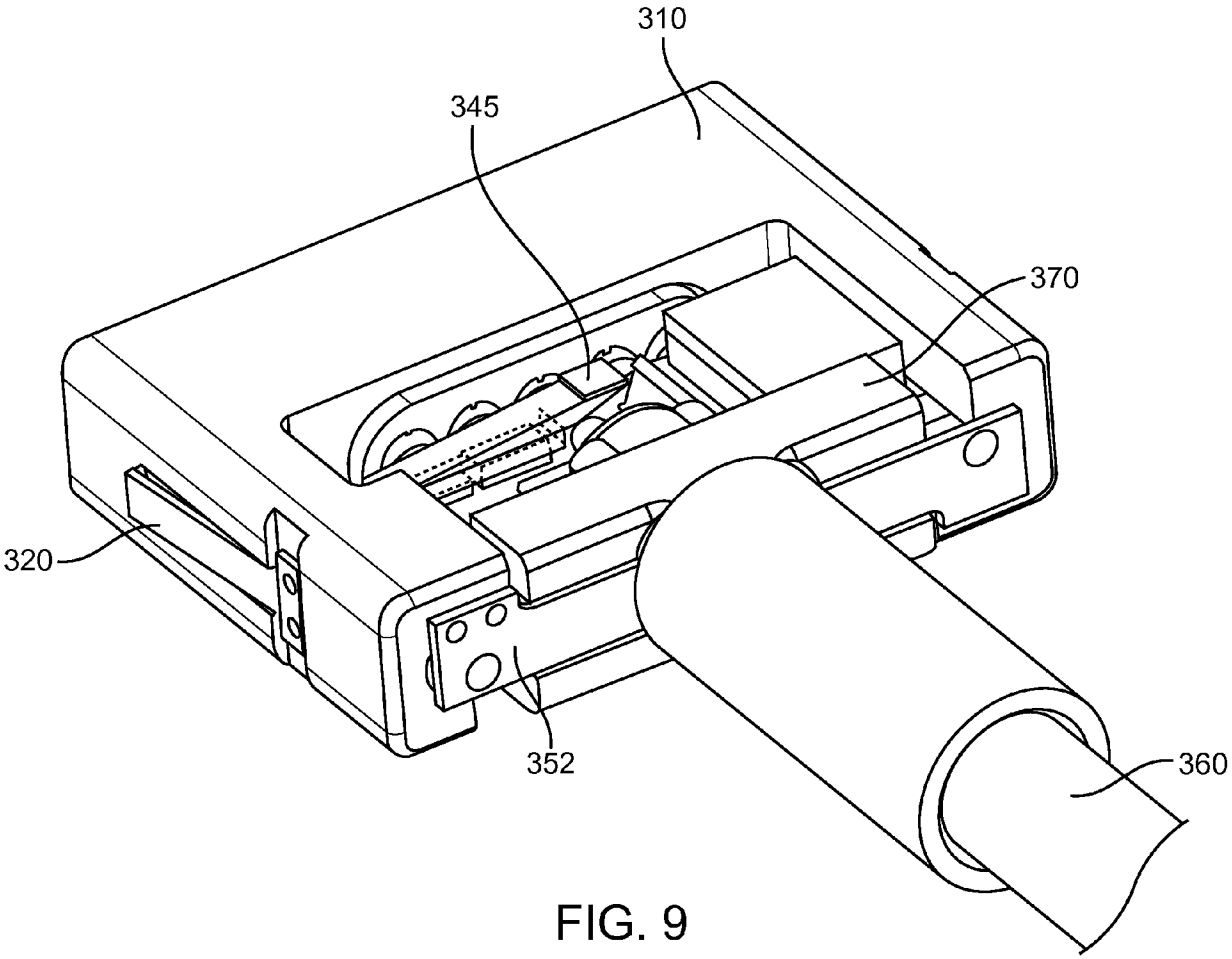
FIG. 9 illustrates a back side of a partial assembly of a connector insert according to an embodiment of the present invention.

FIG. 9 illustrates a back side of a partial assembly of a connector insert according to an embodiment of the present invention. As can be seen, protrusions or wings 352 may be spot or laser welded, or otherwise fixed, to attraction plate 310. This, along with the attachment of fingers 354 to printed circuit board 340, provides a robust mechanical support between cable 360 and attraction plate 310.

Again, retention clips 320 may be attached to attraction plate 310. Shell 380 may slide over this assembly, thereby pressing retention clips 320 flat against the sides of attraction plate 310. A notch or cutout in shell 380 may allow retention clips 320 to snap back, thereby holding shell 380 in place relative to attraction plate 310. An example is shown in the following figure.

Figure 10:
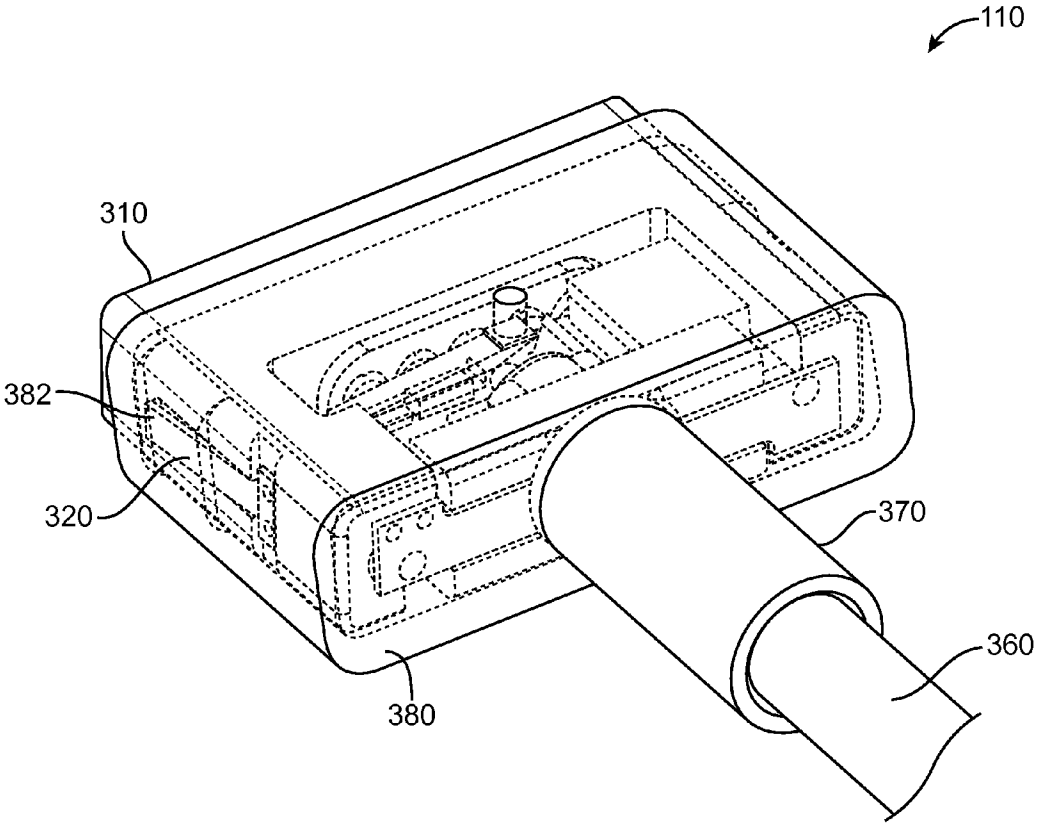
FIG. 10 illustrates a rear view of a connector insert according to an embodiment of the present invention.

FIG. 10 illustrates a rear view of a connector insert according to an embodiment of the present invention. This connector insert may include shell 380 that partially covers attraction plate 310. Retention clips 320 may be relaxed and protruding in cutout 382. This may prevent shell 380 from being slid backward off attraction plate 310 during use. This, in turn, holds shell 380 in place relative to attraction plate 310, and thereby increases the durability of connector insert 110.

In order to reduce the size of a connector insert according to an embodiment of the present invention, it may be desirable to limit the tolerance of the location of the contacts relative to a front surface of attraction plate. This, in turn, allows shorter contacts to be used, and may therefore reduce the length of a connector insert. An example is shown in the following figure.

Figure 11:
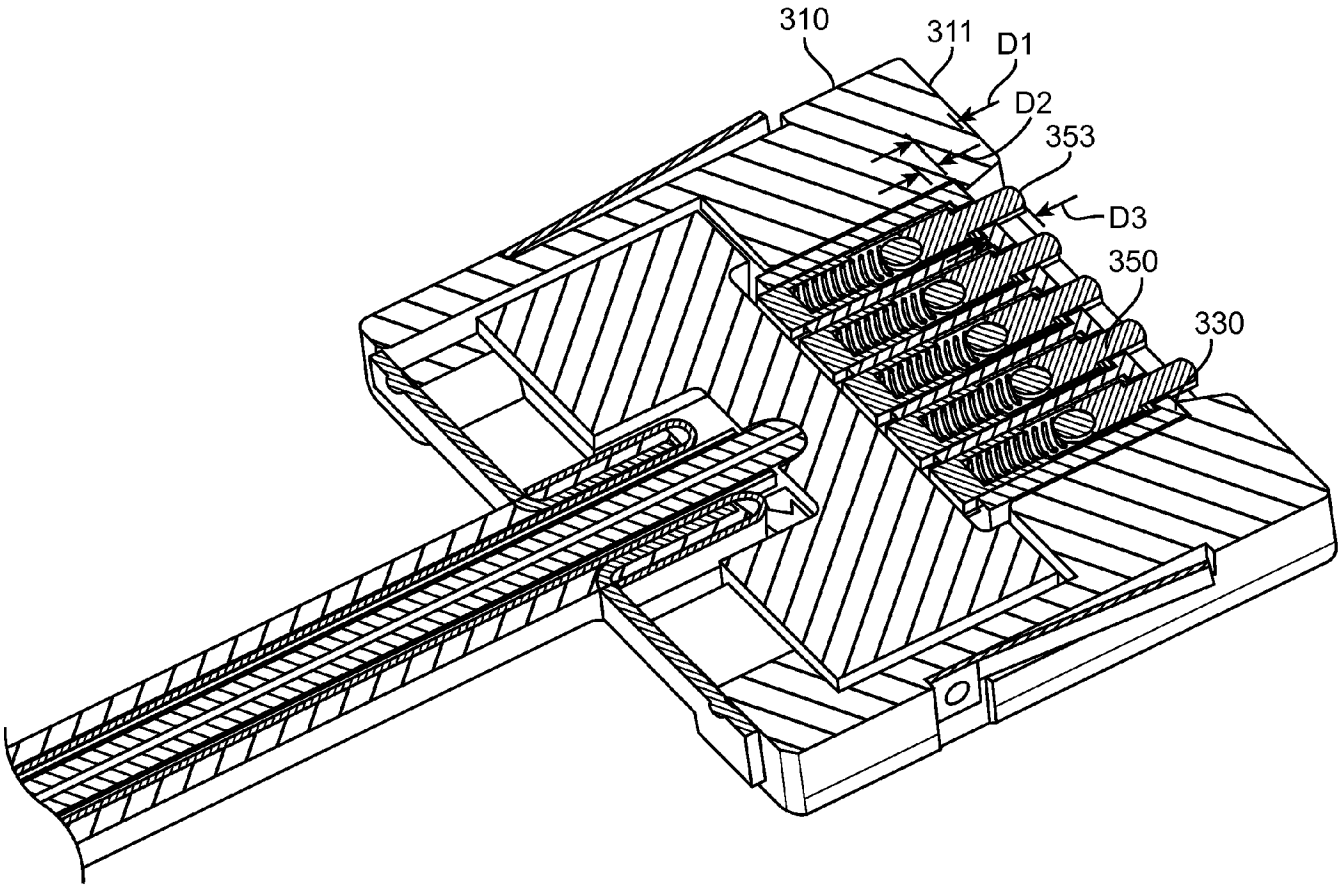
FIG. 11 illustrates a cutaway view of a connector insert according to an embodiment of the present invention.

FIG. 11 illustrates a cutaway view of a connector insert according to an embodiment of the present invention. In this example, the tolerance between leading edge 353 of pin 350 and front edge 311 of attraction plate 310 may be determined by tolerances in a limited number of very short distances. By limiting the number of factors and their lengths, the overall tolerance may be reduced. Specifically, this tolerance is the difference between a sum of the distance D1 from a front edge 311 of attraction plate 310 to a front of housing 330 plus a thickness D2 of a front of housing 330, and a length of a protruding part D3 of pin 350.

Figure 12:
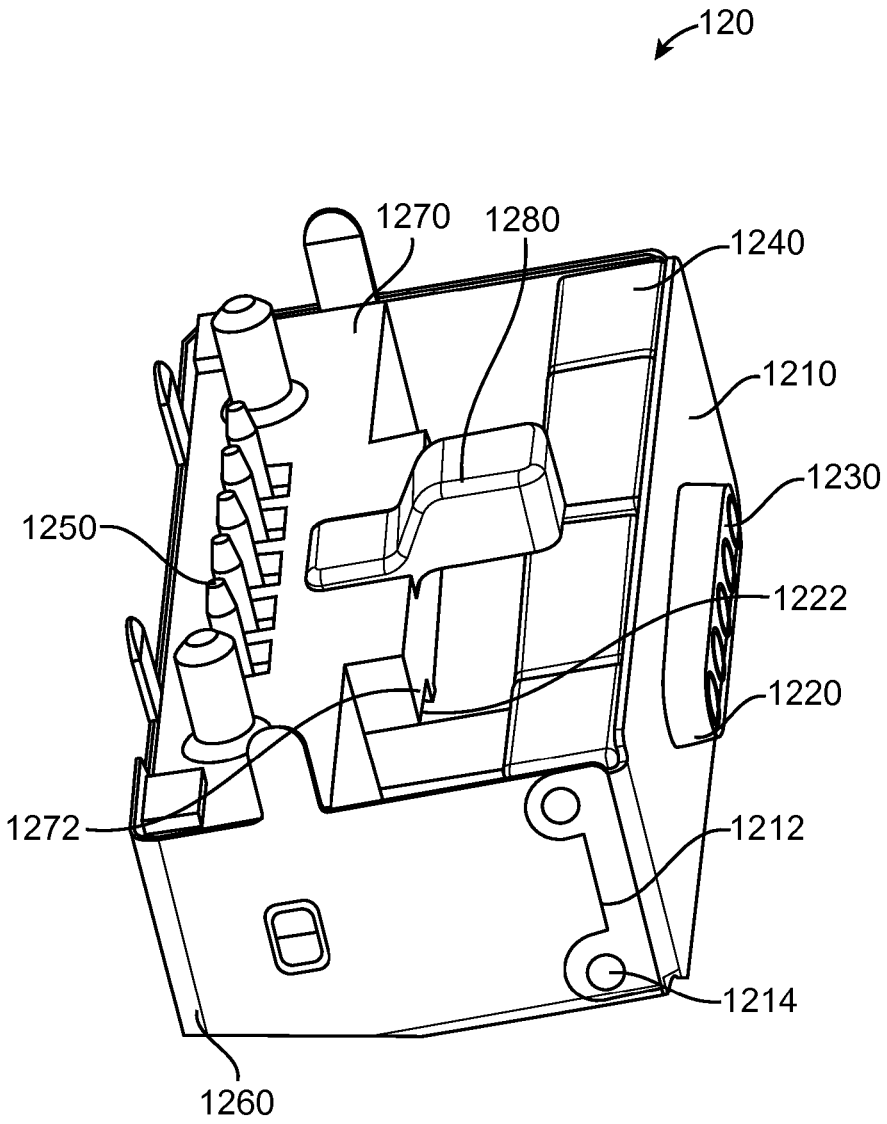
FIG. 12 illustrates a connector receptacle according to an embodiment of the present invention.

FIG. 12 illustrates a connector receptacle according to an embodiment of the present invention. As shown in FIG. 1, receptacle 120 may be inserted or attached to device enclosure 130. Specifically, a bottom of receptacle 120 may rest on an interior surface of enclosure 130, and tab 1280 may fit in a notch in enclosure 130. This may allow for a simple mechanical alignment of connector receptacle 120 in device enclosure 130.

Connector receptacle 120 may include one or more magnets 1240. For example, connector receptacle 120 may include four, fewer than four, or more than four magnets 1240. Magnets 1240 may be covered by label 1210. Label 1210 may be made of ferromagnetic steel or other magnetically conductive material. Label 1210 may attach to shield 1260. Shield 1260 may be formed of non-magnetically conductive steel. In a specific embodiment of the present invention, label 1210 may be low-carbon steel, such as 10-10 steel. This may be plated with nickel, and then plated with platinum nickel.

Label 1210 may attach at tabs 1214 defined by cutout 1212 in shield 1260. Cutout 1212 may reduce the overlap between label 1210 and shield 1260 in order to reduce magnetic losses. Contacts 1230 may be arranged on a mesa formed by housing 1220. Housing 1220 may attach to housing 1270. Housing 1270 may have openings for contacts 1250. The mesa may have sloped edges to provide a non-binding fit when inserted inside opening 260 in attraction plate 210 of connector insert 110.

Figure 13:
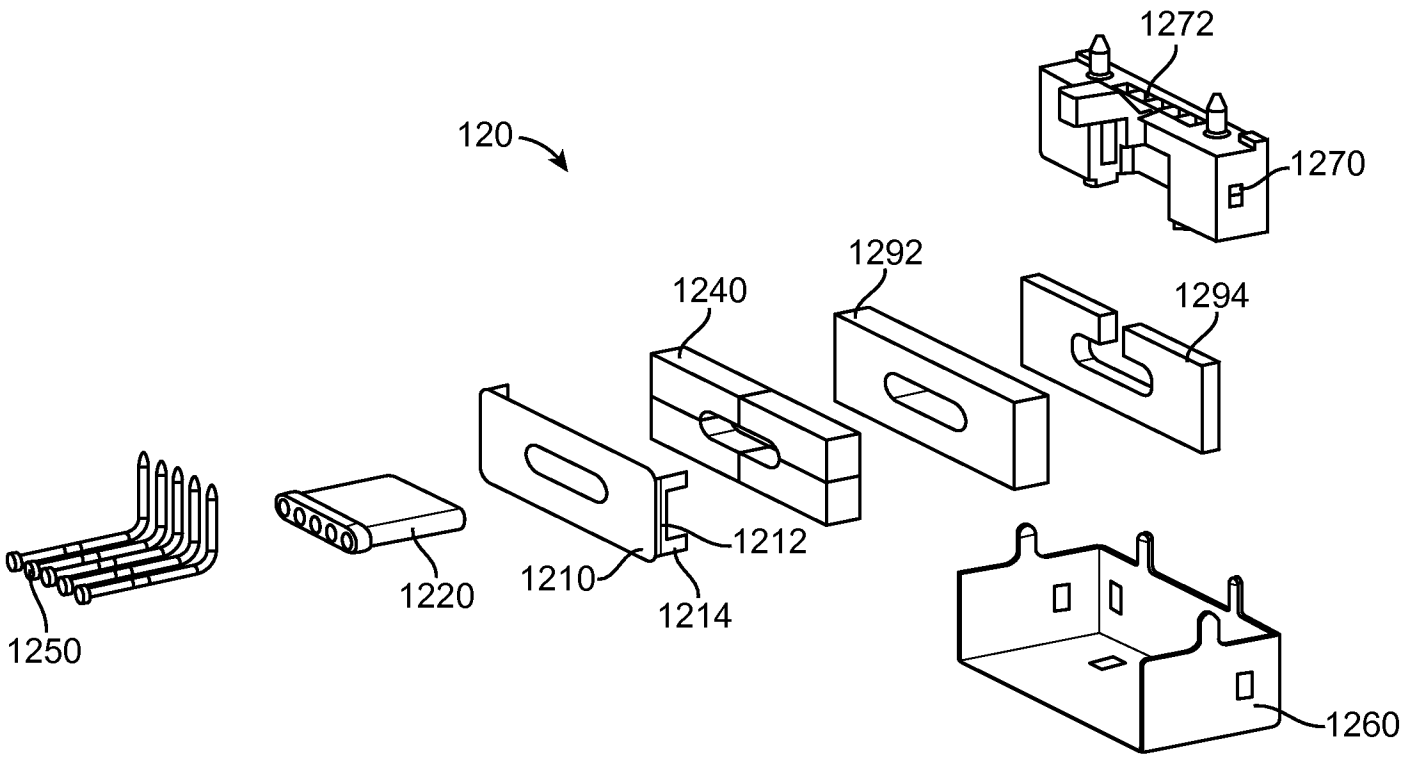
FIG. 13 illustrates an exploded view of a connector receptacle according to an embodiment of the present invention.

FIG. 13 illustrates an exploded view of a connector receptacle according to an embodiment of the present invention. Connector receptacle 120 may include contacts 1250, housing 1220, label 1210, magnets 1240, spacers 1292 and 1294, shield 1260, and housing 1270. Contacts 1250 may be inserted in housing 1220 and bent at a right angle, as shown. Housing 1220 may pass through label 1210, magnets 1240, and spacers 1292 and 1294. By having housing 1220 fit over label 1210, seams between housing 1220 and label 1210 may not be visible to a user. Housing 1270 may include openings 1272 for contacts 1250. This assembly may then be placed in shield 1260. Tabs 1214 on shield 1210 may be spot welded or otherwise fixed to shield 1260.

Label 1210 may be formed of a ferromagnetic material or other magnetically conductive material. This may increase the magnetic attraction of magnets 1240. To reduce wasted magnetic flux, label 1210 may be notched by cutout 1212. More information on labels, and other labels that may be used for or instead of label 1210, may be found in co-pending U.S. provisional application No. 61/522,620, titled LABEL FOR MAGNETIC CONNECTOR, filed Aug. 11, 2011, which is incorporated by reference. Magnets 1240 may be arranged in an alternating South-North configuration such that magnetic field lines originating in one magnet may terminate in an adjoining magnet.

Figure 14:
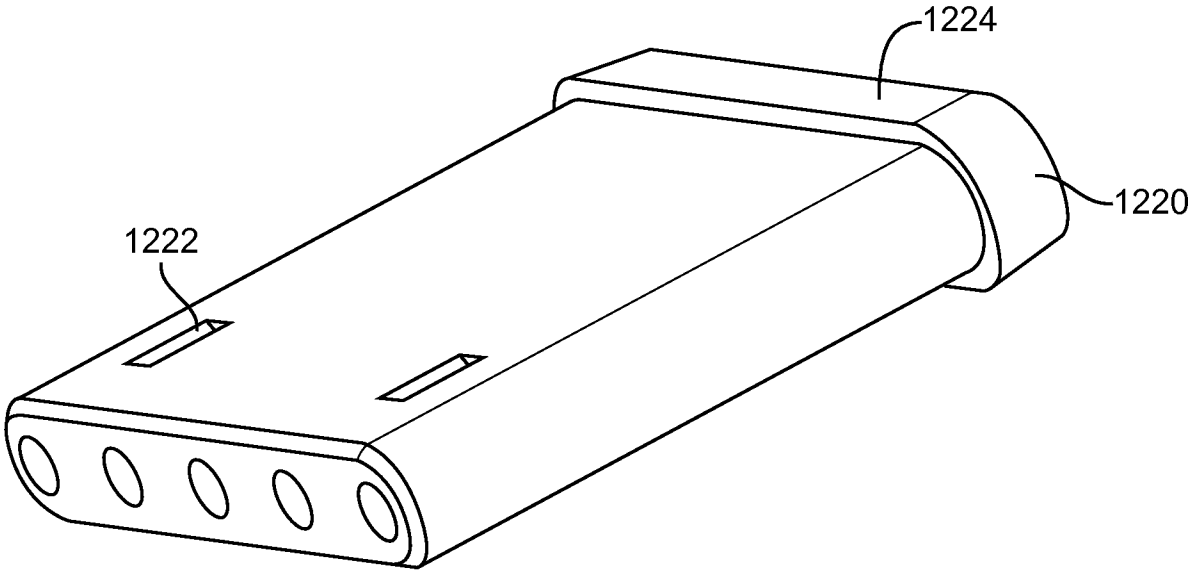
FIG. 14 illustrates a housing according to an embodiment of the present invention.

FIG. 14 illustrates housing 1220. Housing 1220 may include notches 1222 to receive corresponding protrusions on housing 1270. Specifically, protrusions on housing 1270 may fit in notches 1222 to secure the position of housing 1270 relative to housing 1220. Housing 1220 may include an oversized front portion 1224.

Figure 15:
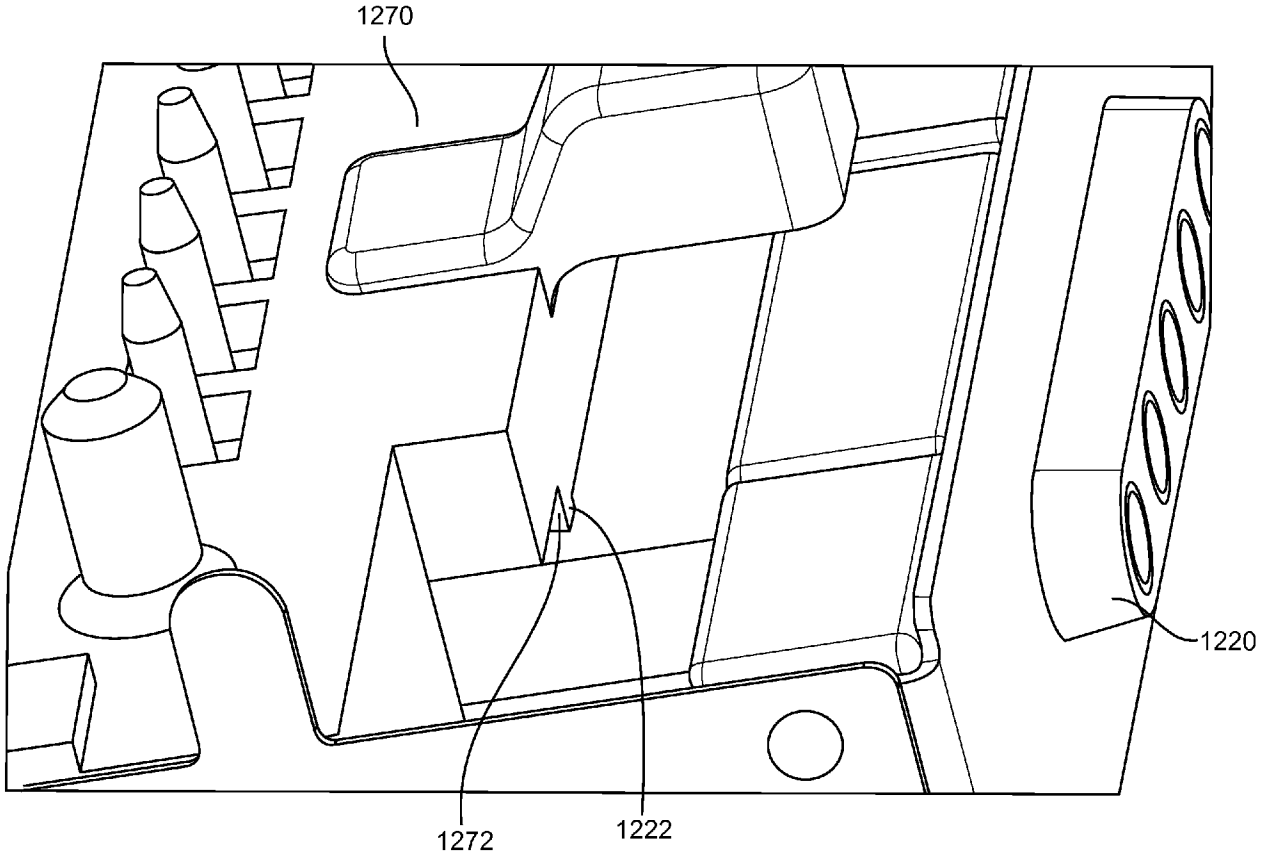
FIG. 15 illustrates a closer view of protrusions and notches on housings according to embodiments of the present invention.

FIG. 15 illustrates a closer view of protrusions 1272 on housing 1270 and notches 1222 on housing 1220.

Figure 16:
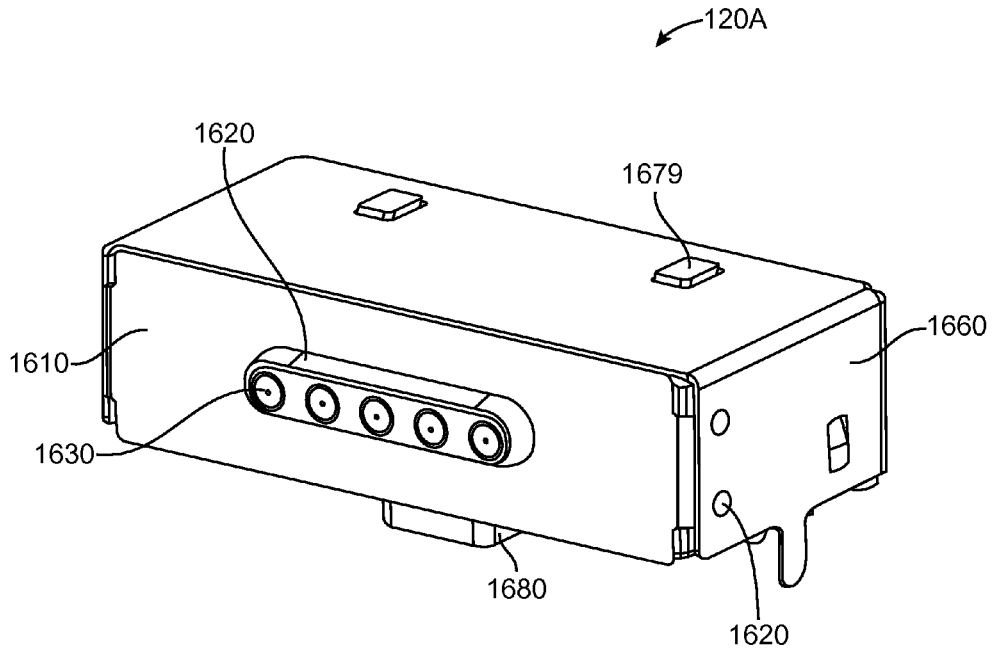
FIG. 16 illustrates another connector receptacle according to an embodiment of the present invention.

FIG. 16 illustrates another connector receptacle according to an embodiment of the present invention. This connector receptacle, or other connector receptacles according to embodiments of the present invention, may be used as connector receptacle 120 in FIG. 1, and is labeled here as 120A. As shown in FIG. 1, receptacle 120 may be inserted or attached to device enclosure 130. Specifically, a bottom of receptacle 120 may rest on an interior surface of enclosure 130, and tab 1680 may fit in a notch in enclosure 130. This may allow for a simple mechanical alignment of connector receptacle 120 in device enclosure 130.

Connector receptacle 120A may include one or more magnets 1640. For example, connector receptacle 120A may include three, fewer than three, or more than three magnets. These magnets may be covered by label 1610. Label 1610 may be made of ferromagnetic steel or other magnetically conductive material. Label 1610 may attach to shield 1660 at points 1614, by laser or spot welding, or other appropriate method. Shield 1660 may be formed of non-magnetically conductive steel. In a specific embodiment of the present invention, label 1610 may be low-carbon steel, such as 10-10 steel. This may be plated with nickel, and then plated with platinum nickel.

Contacts 1630 may be arranged on a mesa formed by housing 1620. The mesa may have sloped edges to provide a non-binding fit when inserted inside opening 260 in attraction plate 210 of connector insert 110. Tabs 1679 on a second housing may fit in openings on a top of shield 1660 to provide mechanical support.

Figure 17:
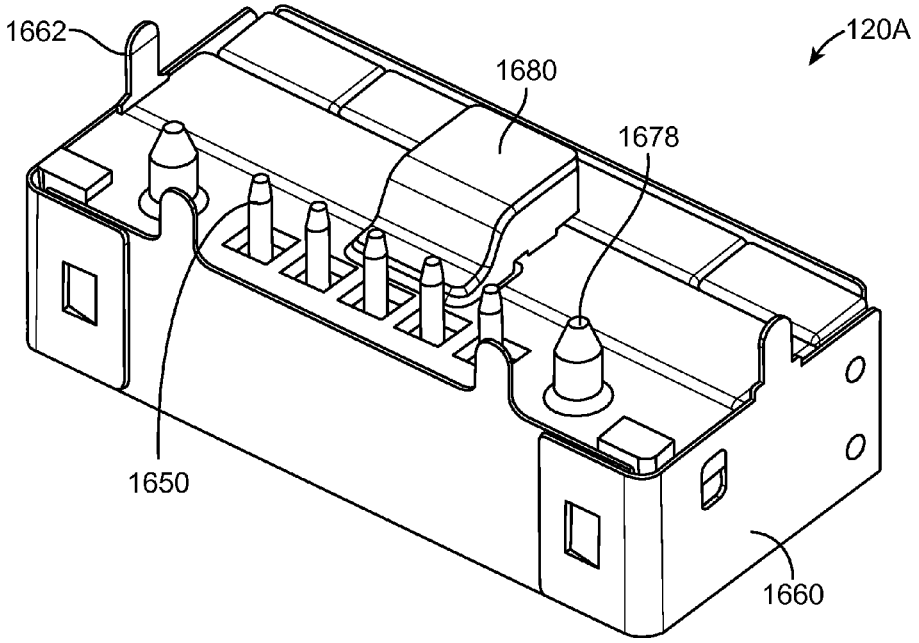
FIG. 17 illustrates a bottom view of a connector receptacle according to an embodiment of the present invention.

FIG. 17 illustrates another view of the connector receptacle of FIG. 16. Contacts 1650 may be through-hole contacts, as shown, or they may be surface mount or other types of contacts. Contacts 1650 may connect to contacts on a printed circuit board, flexible circuit board, or other appropriate substrate. Again, tab 1680 may fit in a notch in enclosure 130. Tabs 1662 and posts 1678 may fit in openings in a printed circuit board, flexible circuit board, or other appropriate substrate.

Figure 18:
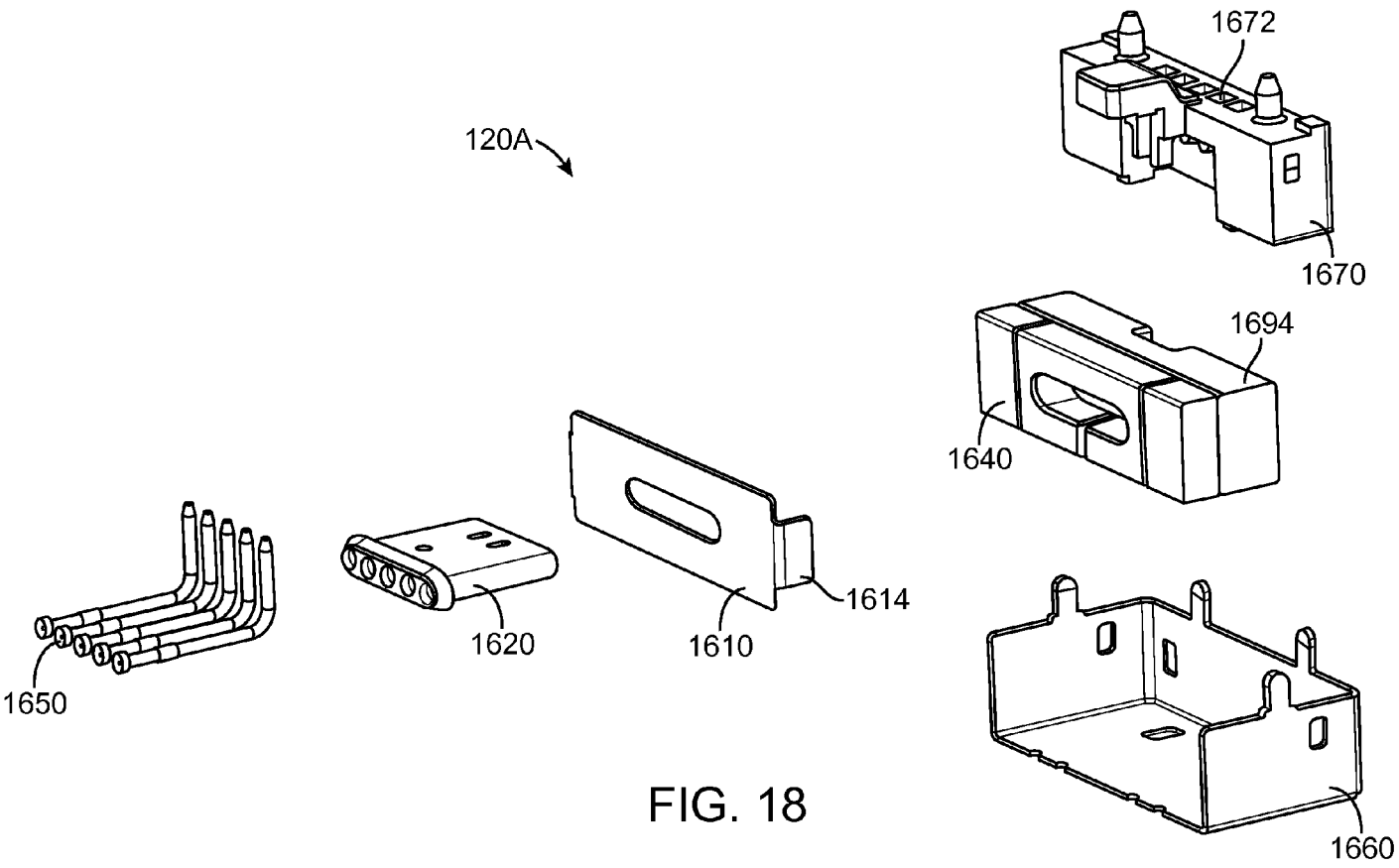
FIG. 18 illustrates an exploded view of a connector receptacle according to an embodiment of the present invention.

FIG. 18 illustrates an exploded view of a connector receptacle according to an embodiment of the present invention. Connector receptacle 120A may include contacts 1650, housing 1620, label 1610, magnets 1640, spacer 1694, shield 1660, and housing 1670. Contacts 1650 may be inserted in housing 1620 and bent at a right angle, as shown. Housing 1620 may pass through label 1610, magnets 1640, and spacer 1694. By having housing 1620 fit over label 1610, seams between housing 1620 and label 1610 may not be visible to a user. Housing 1670 may include openings 1672 for contacts 1650. This assembly may then be placed in shield 1660. Tabs 1614 on shield 1610 may be spot welded or otherwise fixed to shield 1660.

Label 1610 may be formed of a ferromagnetic material or other magnetically conductive material. This may increase the magnetic attraction of magnets 1640. More information on labels, and other labels that may be used for or instead of label 1610, may be found in co-pending U.S. provisional application No. 61/522,620, titled LABEL FOR MAGNETIC CONNECTOR, filed Aug. 11, 2011, which is incorporated by reference. The three magnets 1640 may be arranged in an alternating South-North-South, or North-South-North configuration such that magnetic field lines originating in one magnet may terminate in an adjoining magnet. The middle magnet in magnets 1640 may include a passage for housing 1620 to pass through.

Again, embodiments of the present invention may provide a connector system where a connector insert may be "blind mated" to a connector receptacle. That is, the connector insert and connector receptacle may be configured such that when the connector insert is brought into close proximity to the connector receptacle in approximately a correct orientation, the magnetic attraction between the connector insert and the connector receptacle is such that the connector insert may be pulled into contact with the connector receptacle.

This may provide an easy way for a user to make a connection of a cable to a device. Specifically, the user may simply bring the connector insert in approximately a correct orientation and into proximity of the connector receptacle. From there, the magnetic attraction between the connector insert and the connector receptacle may bring them into contact.

To facilitate this blind mating, the physical features on the connector insert and connector receptacle may be such that there may be no obstacles to the formation of the connection. For example, opening 260 on attraction plate 210 of connector insert 110 may be such that it readily accepts mesa 1220 or mesa 1620 on connector receptacles. Similarly, attraction plate 210 of connector insert 110 may be such that it readily fits in an opening in device 130.

Figure 19:
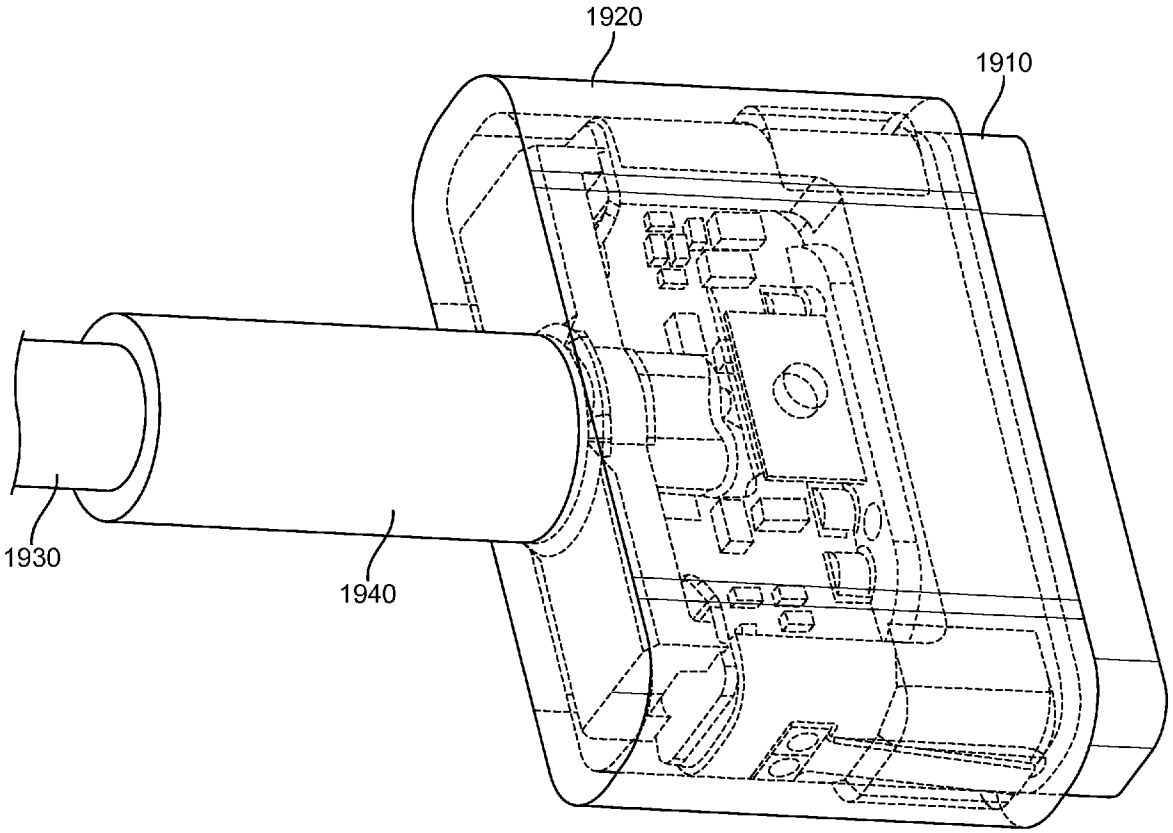
FIG. 19 illustrates a connector insert according to an embodiment of the present invention.

FIG. 19 illustrates a connector insert according to an embodiment of the present invention. This connector insert may include attraction plate 1910, shield or cover 1920, cable 1930, and strain relief 1940. As before, attraction plate 1910 may include a front surface (not shown) having an opening for contacts (not shown). These contacts may include contacts for ground and power. One or more other contacts may be used to detect that a connection with a connector receptacle has been formed, or for other purposes. As before, ground contacts may protrude in front of the other contacts of this connector such that ground paths are formed before power is applied when this connector insert is mated with a corresponding connector receptacle.

As before, this connector insert may be relatively thin. That is, it may have a reduced height. To compensate for this, that is, to increase magnetic attraction between this connector insert and a corresponding connector receptacle, an area of the front surface of attraction plate 1910 may be increased. For example, this may be done by making the connector insert wider. By making the connector insert wider, the area of the front surface of attraction plate 1910 may be increased, which may increase the holding power of the connector insert.

Again, these connector inserts may be inserted and disconnected several thousand times during the lifetime of the device. Therefore, it may be desirable that this connector insert be robust and durable. Accordingly, embodiments of the present invention may employ several features to increase robustness and durability. For example, the physical connections between cable 1930 and attraction plate 1910, as well as shell 1920 and attraction plate 1910, may be enhanced. Examples are shown in the following figures.

Figure 20:
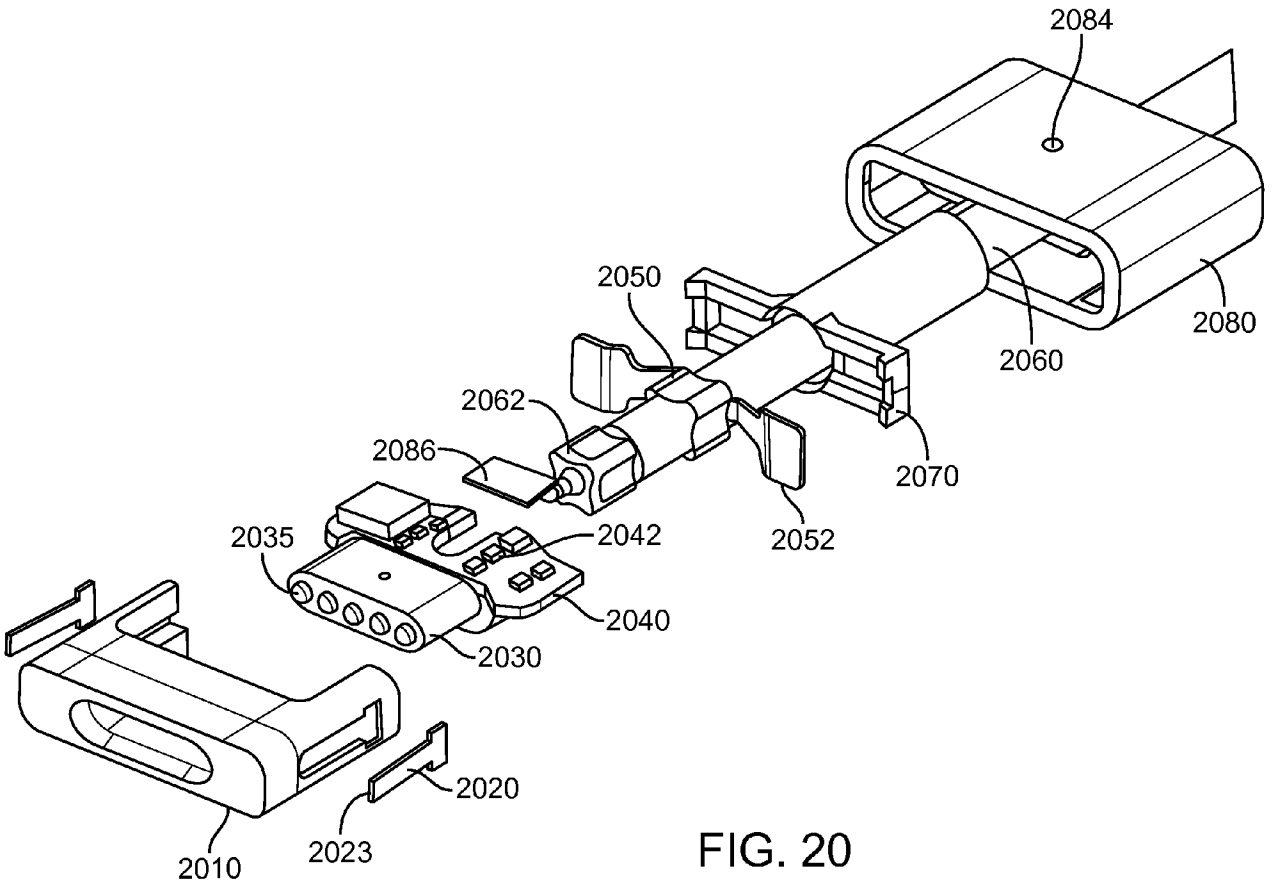
FIG. 20 illustrates an exploded view of a connector insert according to an embodiment of the present invention.

FIG. 20 illustrates an exploded view of a connector insert according to an embodiment of the present invention. This figure includes attraction plate 2010. Attraction plate 2010 may be made of a ferromagnetic or other magnetic material. In other embodiments of the present invention, attraction plate 2010 may be formed of one or more magnets, such as rare-earth magnets.

Retention clips 2020 may be located on sides of attraction plate 1910. Retention clips 2020 may be used to secure shell 2080 relative to attraction plate 2010. Specifically, retention clips 2020 may be biased away from attraction plate 2010. Shell 2080 may slide over attraction plate 2010, pushing retention clips 2020 against attraction plate 2010. When edge 2023 reaches a cutout (not shown) inside of shell 2080, retention clip 2020 may snapback, thereby holding shall 2080 in place.

Housing 2030 may be formed of a non-connecting or insulating material. Contacts 2035 may be located in passages in housing 2030. Contacts 2035 may attach to circuit board 2040. Circuit board 2040 may include one or more LEDs 2042. Light emitted from LEDs 2042 may pass through light pipes or diffuser 2860 to opening 2084 in shell 2080. Braiding 2062 in cable 2060 may be pulled back and held in place by crimp piece 2050. Crimp piece 2050 may include wings or protrusions 2052. Wings 2052 may be spot or laser welded, soldered, or otherwise fixed, to a back of attraction plate 2010 to hold cable 2060 in place relative to attraction plate 2010. Strain relief 2070 may protect cable 2060. Shell 2080 may be placed over these components and at least part of attraction plate 2010.

Shell 2080 may provide a surface that may be manipulated by a user during insertion and extraction of the connector insert. Shell 2080 may the plastic, brushed aluminum, or other material. Shell 2080 may include openings 2084 on one or more sides. These openings may be filled with epoxy or other clear or colored material to prevent debris from entering opening 2084. Again, connector inserts according to embodiments of the present invention may be assembled in various ways. A specific example is shown in the following figures.

Figure 21:
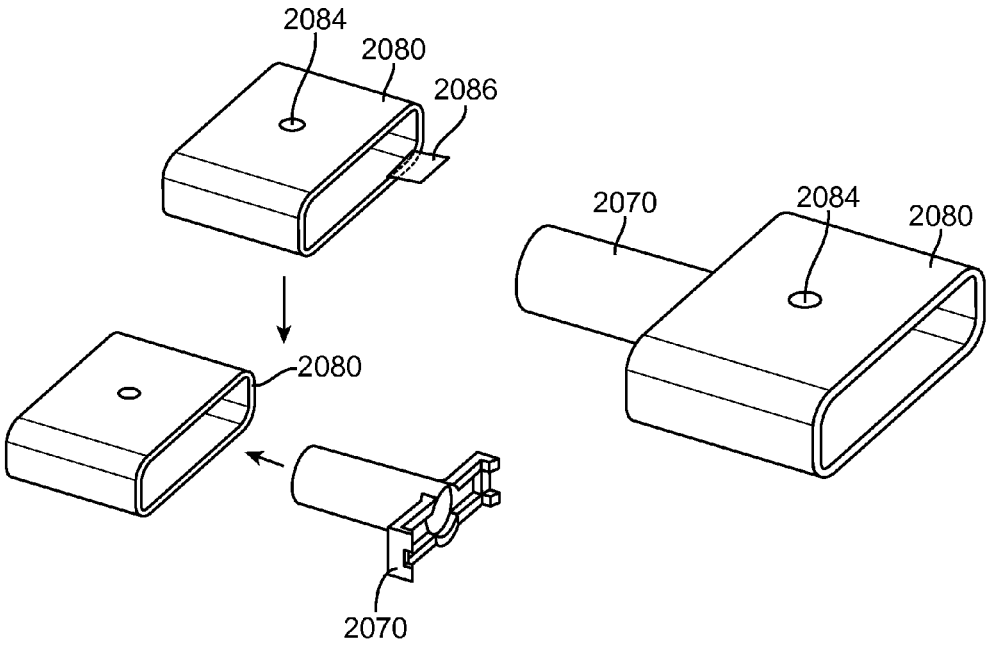
FIG. 21 illustrates the assembly of a portion of a connector insert according to an embodiment of the present invention.

FIG. 21 illustrates the assembly of a portion of a connector insert according to an embodiment of the present invention. Diffuser 2086 may be attached to shell 2080 such that the diffuser covers opening 2084. Strain relief 2070 may be inserted in shell 2080.

Figure 22:
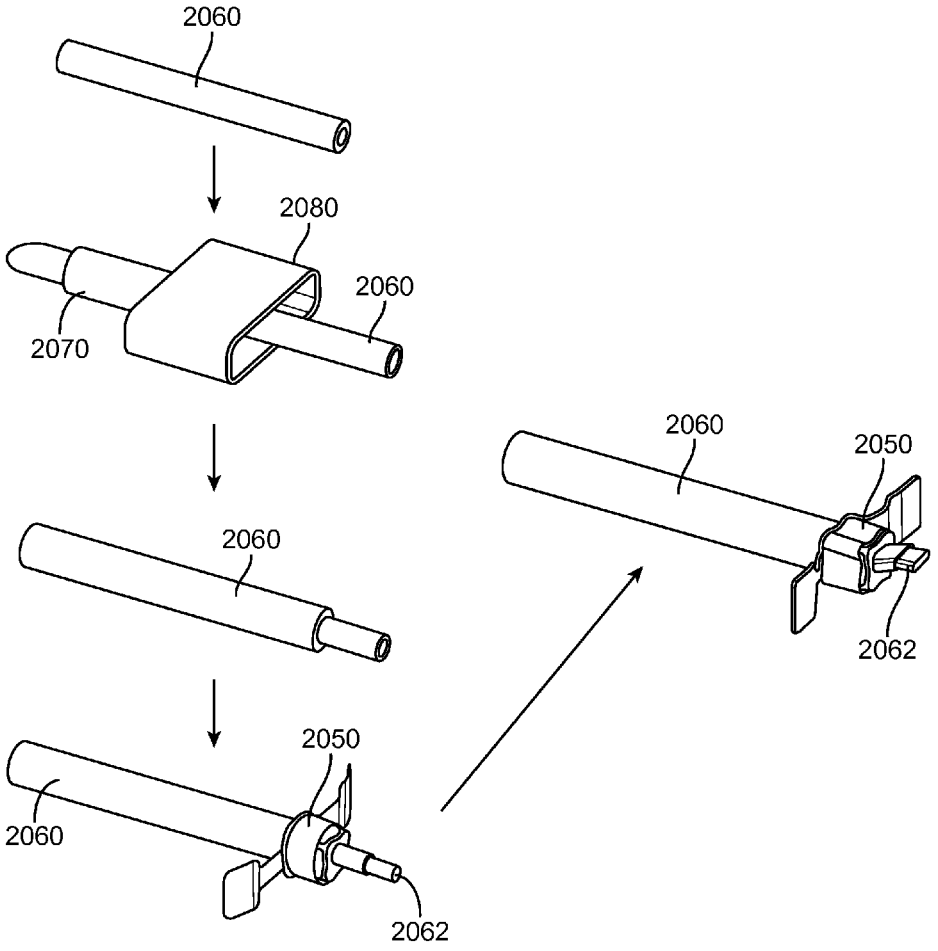
FIG. 22 illustrates the assembly of another portion of a connector insert according to an embodiment of the present invention.

FIG. 22 illustrates the assembly of another portion of a connector insert according to an embodiment of the present invention. Here strain relief 2070 and shell 2080 are slid over an end of cable 2060. The end of cable 2060 may be stripped, and the braiding of the cable pulled back over the cable. Crimping piece 2050 may be placed over the end of cable 2060 and crimped. Conductor 2062 may be flattened to assist in its connection to a printed circuit board in the connector insert, as is shown below.

Figure 23:
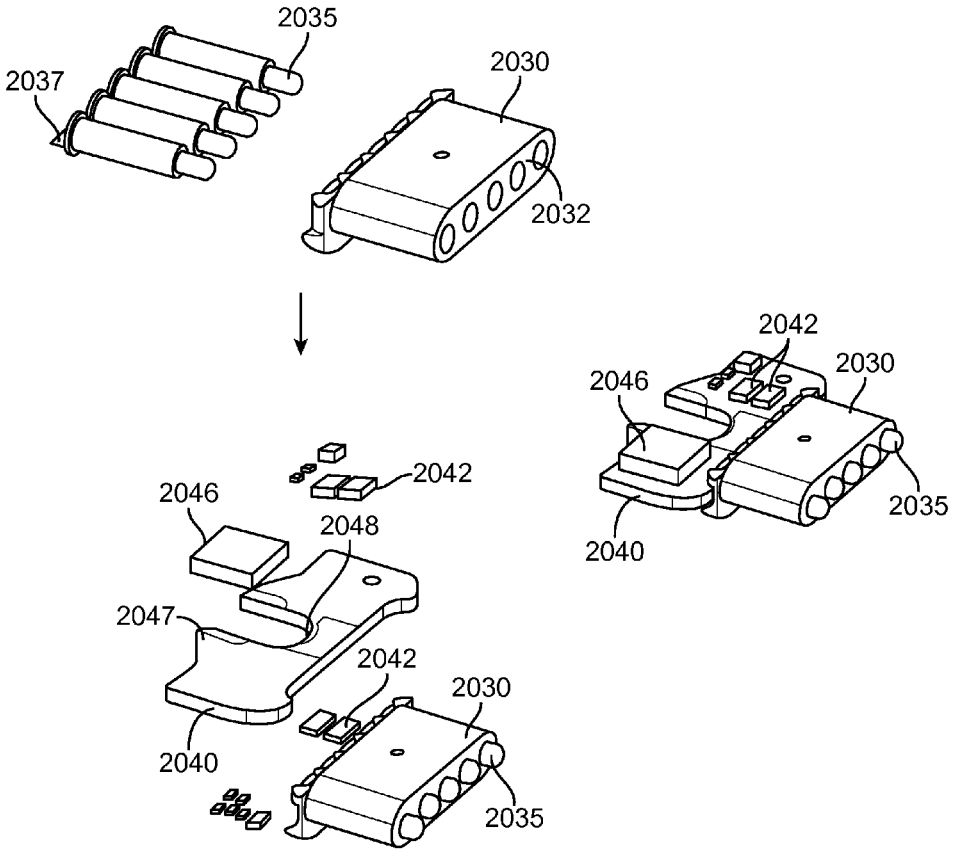
FIG. 23 illustrates the assembly of another portion of a connector insert according to an embodiment of the present invention.

FIG. 23 illustrates the assembly of another portion of a connector insert according to an embodiment of the present invention. Contacts 2035 may be inserted into openings 2032 in housing 2030. LEDs 2042 and other circuitry 2046 may be placed on printed circuit board 2040. Tail portions 2037 of contacts 2035 may be soldered to corresponding contacts (not shown) on circuit board 2050, thereby attaching housing 2030 and contacts 2035 to printed circuit board 2040.

Printed circuit board 2040 may include ground contacts 2047 and power contact 2048. Ground contact 2047 and power contact 2048 may be spot or laser welded, soldered, or otherwise fixed, to crimping piece 2050 and conductor 2026, respectively, as is shown below.

Figure 24:
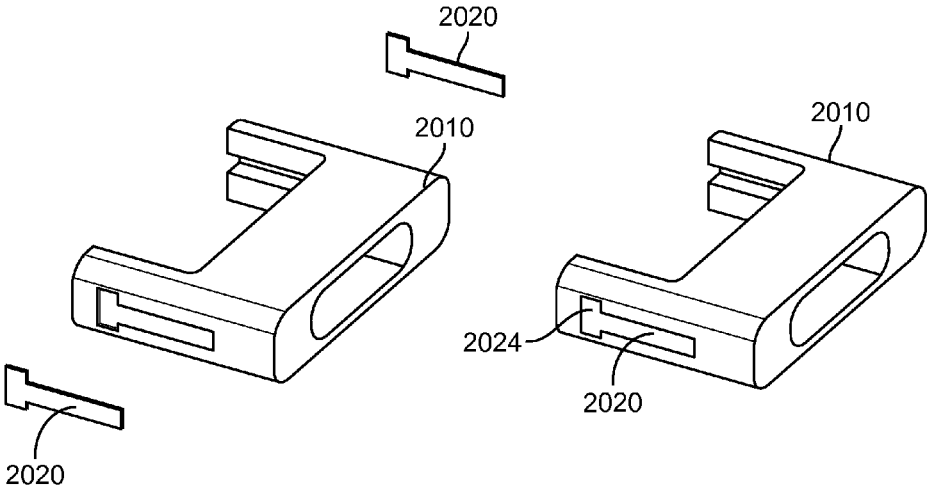
FIG. 24 illustrates the assembly of another portion of a connector insert according to an embodiment of the present invention.

FIG. 24 illustrates the assembly of another portion of a connector insert according to an embodiment of the present invention. Retention clips 2020 may be attached to attraction plate 2010. Specifically, retention clips 2020 may be attached to attraction plate 2010 by spot or laser welding, soldering, or other appropriate method, at location 2024.

Figure 25:
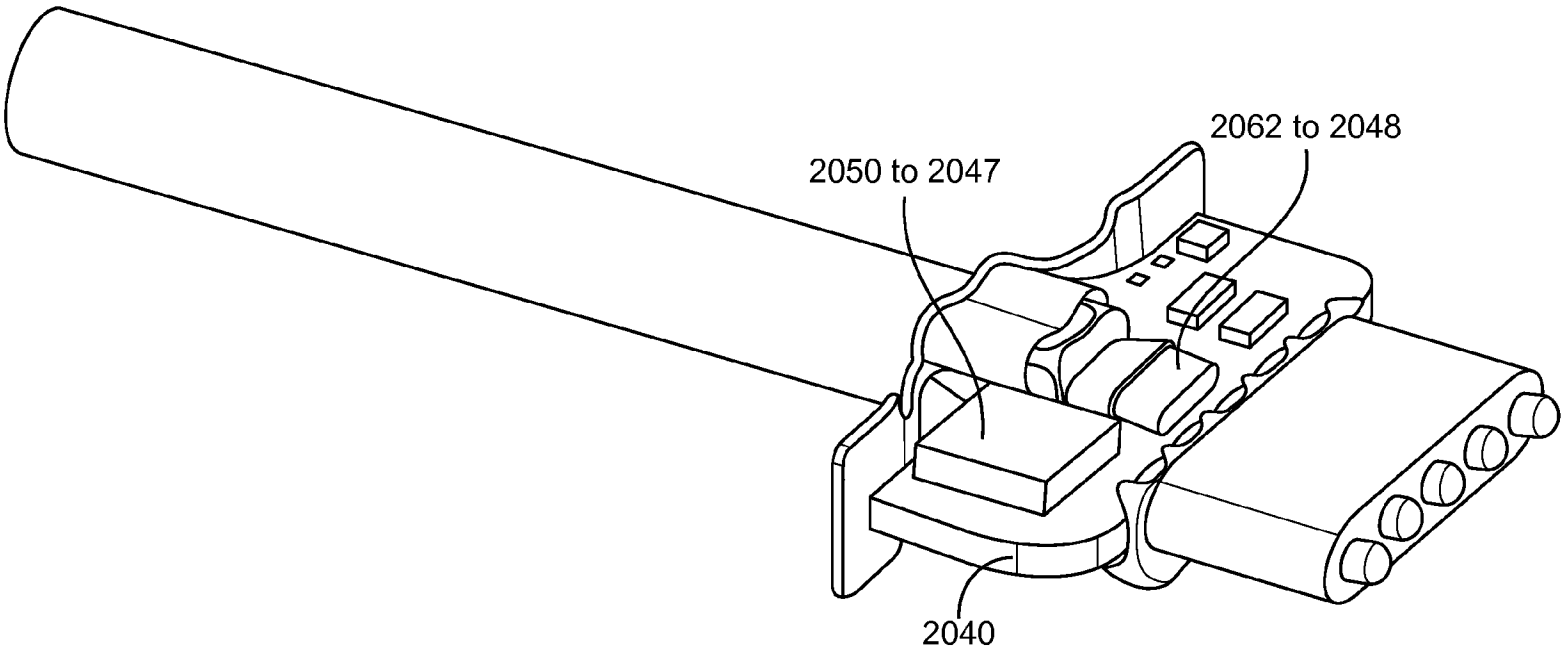
FIG. 25 illustrates the assembly of another portion of a connector insert according to an embodiment of the present invention.

FIG. 25 illustrates the assembly of another portion of a connector insert according to an embodiment of the present invention. Again, crimping piece 2050 may be laser or spot welded, soldered, or otherwise fixed to contact 2047. Similarly, conductor 2026 may be laser or spot welded, soldered, or otherwise fixed, to contact 2048 on printed circuit board 2040.

Figure 26:
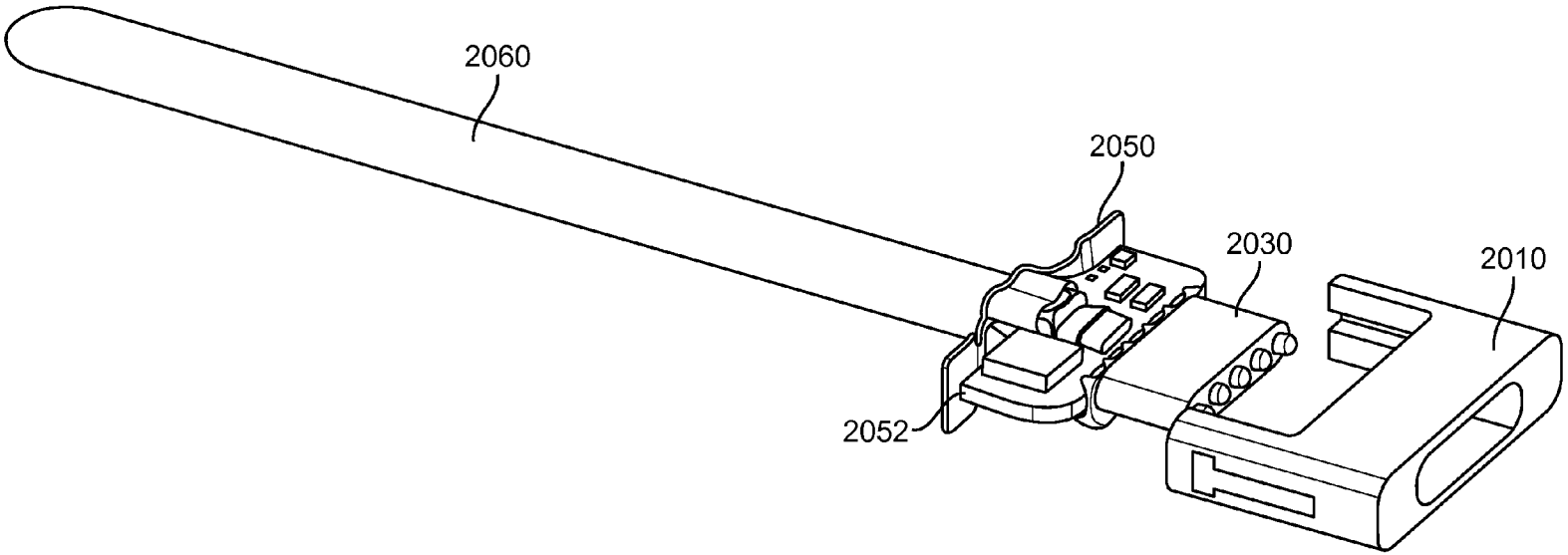
FIG. 26 illustrates the assembly of another portion of a connector insert according to an embodiment of the present invention.

FIG. 26 illustrates the assembly of another portion of a connector insert according to an embodiment of the present invention. Again, wings or protrusions 2052 of crimping piece 2050 may be spot or laser welded, soldered, or otherwise fixed, to a back of attraction plate 2010.

Figure 27:
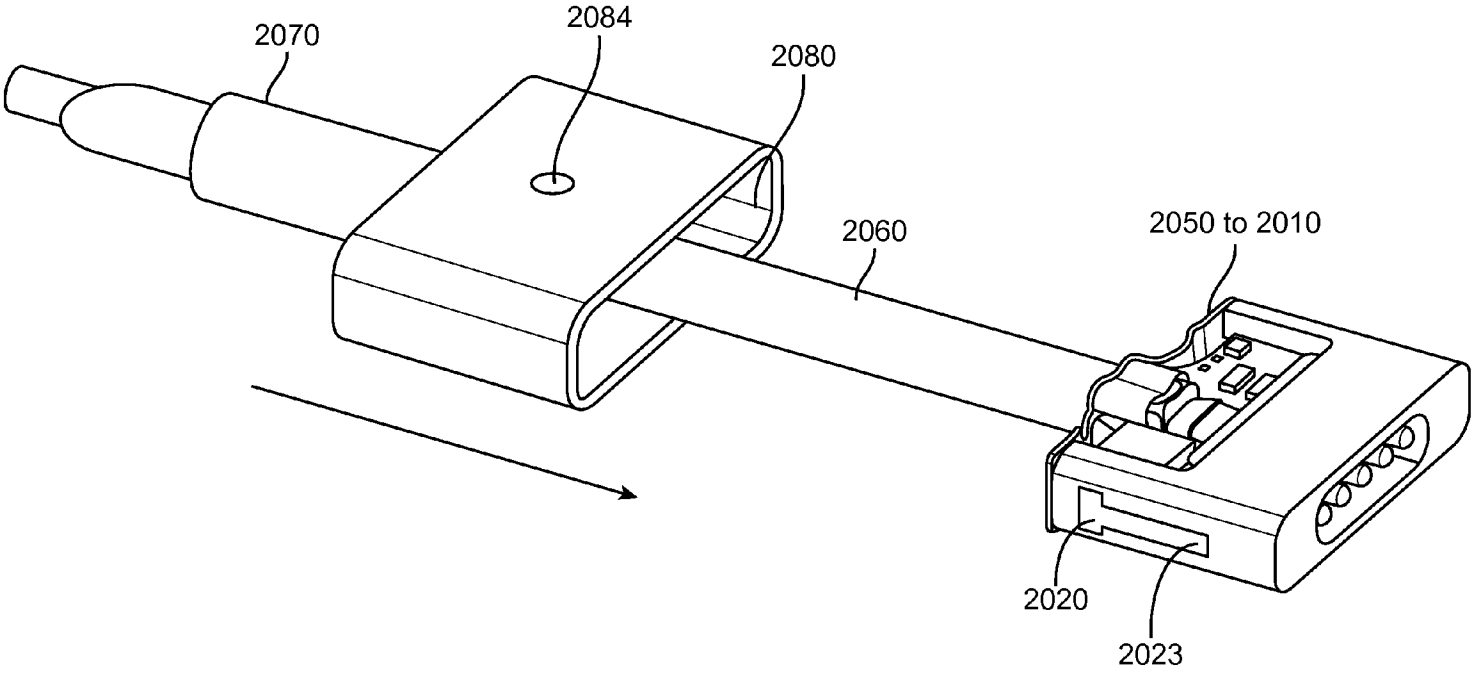
FIG. 27 illustrates the assembly of another portion of a connector insert according to an embodiment of the present invention.

FIG. 27 illustrates the assembly of another portion of a connector insert according to an embodiment of the present invention. Again, wings or protrusions 2052 may be spot or laser welded, soldered, or otherwise fixed to a back of attraction plate 2010. Housing 2080 may be slid over attraction plate 2010. Again, leading edges 2023 of retention clips 2020 may be biased away from attraction plate 2010. As shell 2080 is slid over attraction plate 2010, retention clips 2020 may be pressed against attraction plate 2010, then released as a slot or cutout (not shown) on the side of shell 2080 is reached. At this point, leading edge 2023 may snap back, thereby holding shell 2080 in place relative to attraction plate 2010.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector insert comprising:

an insulative housing having a number of passages;

a plurality of contacts, each located in a corresponding passage in the insulative housing;

a printed circuit board attached to the plurality of contacts;

an attraction plate;

a cable;

a crimping portion crimped over an end of the cable and having a plurality of protrusions, wherein the plurality of protrusions are attached to a back of the attraction plate;

a plurality of retention clips on sides of the attraction plate; and a shell around the printed circuit board having a cutout portion to accept the retention clips.

2. The connector insert of claim 1 further comprising:

a first light-emitting diode attached to the printed circuit board; and a light pipe attached to the printed circuit board, wherein the light pipe is angled to pass above the first light-emitting diode, and further angled to pass light to an opening in the shell.

3. The connector insert of claim 2 further comprising:

a second light-emitting diode attached to the printed circuit board, wherein the light pipe is angled to pass above the first light-emitting diode and the second light-emitting diode.

4. The connector insert of claim 1 wherein the crimping portion further comprises a plurality of fingers extending in a first direction along a length of the cable.

5. The connector insert of claim 4 wherein the plurality of protrusions extend along a second direction orthogonal to the first direction.

6. The connector insert of claim 1 further comprising:

a strain relief partially covered by the shell, and extending behind the shell and around the cable.

7. The connector insert of claim 1 wherein the crimping portion further comprises a plurality of fingers, wherein the plurality of fingers are attached to the printed circuit board.

8. A method of assembling a connector insert comprising:

inserting a plurality of contacts into corresponding passages in a non-conductive housing;

attaching the contacts to a printed circuit board;

crimping a first end of a cable with a crimping piece;

inserting the housing into an attraction plate;

attaching retention clips to the attraction plate;

fixing a first protrusion of the crimping piece to a back of the attraction plate;

sliding a strain relief portion into contact with a back of the attraction plate; and sliding a shell over a rear portion of the attraction plate until a cutout in the shell accepts the retention clips.

9. The method of claim 8 further comprising:

attaching a first finger of the crimping piece to the printed circuit board.

10. The method of claim 9 further comprising:

attaching a second finger of the crimping piece to the printed circuit board; and fixing a second protrusion of the crimping piece to the back of the attraction plate.

11. The method of claim 10 wherein the first finger is attached to a first side of the printed circuit board and the second finger is attached to a second side of the printed circuit board.

12. The method of claim 8 further comprising:

attaching a light-emitting diode to the printed circuit board; and attaching a light pipe to the printed circuit board and over the light-emitting diode.

13. A connector receptacle comprising:

a plurality of magnets;

a label covering a front surface of the plurality of magnets such that the label is between the plurality of magnets and a connector insert when the connector insert is mated with the connector receptacle, wherein the label is formed of a magnetically conductive material;

a first housing passing through the plurality of magnets and having a plurality of passages;

a second housing fixed to the first housing and having a plurality of passages;

a plurality of contacts, each in a corresponding passage in the first housing and the second housing; and a shell around the second housing and attached to the label.

14. The connector receptacle of claim 13 wherein an overlap of the label and the shell is reduced by a cutout in the label.

15. The connector receptacle of claim 13 wherein the plurality of magnets comprises three magnets arranged to have alternating polarities.

16. The connector receptacle of claim 13 wherein the plurality of magnets comprises four magnets, two in each of two rows, and arranged to have alternating polarities in and between rows.

17. The connector receptacle of claim 13 wherein the second housing includes a tab to be inserted in a notch in a device enclosure.

18. A connector receptacle comprising:

a plurality of magnets;

a label over the plurality of magnets, wherein the label is formed of a magnetically conductive material;

a first housing passing through the plurality of magnets and having a plurality of passages;

a second housing fixed to the first housing and having a plurality of passages;

a plurality of contacts, each in a corresponding passage in the first housing and the second housing; and a shell around the second housing and attached to the label, wherein the plurality of magnets comprises three magnets arranged to have alternating polarities, and wherein a middle magnet includes a passage for the first housing.

19. A method of assembling a connector receptacle comprising:

inserting a plurality of contacts into corresponding passages in a first housing, wherein the first housing has an oversized front portion;

passing the first housing through a label and a plurality of magnets;

bending the contacts at a right angle;

inserting the resulting right-angled portions of the contacts into openings of a second housing;

fixing the position of the second housing relative to the first housing; and attaching a shield to the label, passing the first housing through a spacer, the spacer located between the plurality of magnets and the second housing.

20. A method of assembling a connector receptacle comprising:

inserting a plurality of contacts into corresponding passages in a first housing, wherein the first housing has an oversized front portion;

passing the first housing through a label and a plurality of magnets;

bending the contacts at a right angle;

inserting the resulting right-angled portions of the contacts into openings of a second housing;

fixing the position of the second housing relative to the first housing; and attaching a shield to the label, wherein passing the first housing through a label and plurality of magnets comprises passing the first housing through an opening formed in a center magnet of three magnets.

21. The method of claim 19 wherein passing the first housing through a label and plurality of magnets comprises passing the first housing through an opening formed by four magnets.

* * * * *